US008750739B2

(12) United States Patent
Tamaki et al.

(10) Patent No.: US 8,750,739 B2
(45) Date of Patent: Jun. 10, 2014

(54) IMAGE FORMING APPARATUS

(75) Inventors: Masayuki Tamaki, Toride (JP); Toshinori Nakayama, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 83 days.

(21) Appl. No.: 13/587,384

(22) Filed: Aug. 16, 2012

(65) Prior Publication Data

US 2013/0051830 A1 Feb. 28, 2013

(30) Foreign Application Priority Data

Aug. 23, 2011 (JP) ..... 2011-181176

(51) Int. Cl.
*G03G 15/20* (2006.01)

(52) U.S. Cl.
USPC ..... 399/69

(58) Field of Classification Search
USPC ..... 399/45, 69, 70
See application file for complete search history.

(56) References Cited

U.S. PATENT DOCUMENTS

| | | | | |
|---|---|---|---|---|
| 6,934,484 | B2 * | 8/2005 | Suzuki et al. | 399/69 |
| 7,260,351 | B2 | 8/2007 | Nakayama | |
| 7,263,303 | B2 | 8/2007 | Nakayama | |
| 7,343,130 | B2 | 3/2008 | Nakayama | |
| 7,430,392 | B2 | 9/2008 | Ito et al. | |
| 7,460,821 | B2 | 12/2008 | Ai et al. | |
| 7,505,724 | B2 | 3/2009 | Nakayama | |
| 7,590,366 | B2 | 9/2009 | Nakayama | |
| 7,729,628 | B2 | 6/2010 | Nakayama | |
| 7,907,861 | B2 | 3/2011 | Nakayama | |
| 8,145,086 | B2 | 3/2012 | Chiyoda et al. | |
| 8,306,446 | B2 | 11/2012 | Ito et al. | |
| 2009/0097868 | A1 | 4/2009 | Ikeda | |
| 2011/0305473 | A1 | 12/2011 | Tamaki | |
| 2012/0027477 | A1 | 2/2012 | Nakayama | |
| 2012/0093550 | A1 | 4/2012 | Takemura | |
| 2012/0107002 | A1 | 5/2012 | Nakayama et al. | |
| 2012/0224876 | A1 | 9/2012 | Nakayama et al. | |

FOREIGN PATENT DOCUMENTS

| | | | |
|---|---|---|---|
| JP | 9-305058 | A | 11/1997 |
| JP | 2004-295144 | A | 10/2004 |
| WO | WO 2012/029980 | A1 | 3/2012 |

OTHER PUBLICATIONS

Great Britain Office Action dated Dec. 20, 2012, in counterpart UK Application No. GB1215042.1.

* cited by examiner

*Primary Examiner* — Hoang Ngo
(74) *Attorney, Agent, or Firm* — Fitzpatrick, Cella, Harper & Scinto

(57) ABSTRACT

An image forming apparatus includes an image forming device a fixing device having a fixing nip by wherein in an image forming process of the image forming device, $0<B<\rho\pi L/(30\times 3^{1/2})$ is satisfied where L (μm) is a volume average particle size of toner of the unfixed toner image, ρ (g/cm^3) is a density of the toner, B (mg/cm^2) is a maximum toner deposition amount, per unit area, on a predetermined recording paper, wherein the fixing device fixes the toner image while satisfying that, at an outlet of the fixing nip, a viscosity of a toner layer contacting the fixing device is not higher than 1500 (Pa·s), and a viscosity of a toner layer contacting the recording paper is not lower than 3000 (Pa·s).

9 Claims, 24 Drawing Sheets

| FIG.23A | FIG.23B |
|---|---|

IMAGE FORMING APPARATUS

FIELD OF THE INVENTION AND RELATED ART

The present invention relates to an image forming apparatus such as a copying machine, a facsimile machine, a printer or a complex machine of them, which forms a toner image on a recording paper using an electrophotographic process or the like and which comprises a fixing device for fixing the toner image on the recording paper. More particularly, it relates to an image forming apparatus comprising a low toner deposition amount system with which a toner consumption amount is small.

A method of visualizing image information using an electrophotographic method or the like is used in various fields, such as the copying-machine field, the printer field, or the like, with development of the technique and the enlargement of the market demand. Recently, it is desired to reduce the toner consumption amount from the standpoint of the running cost. The reduction of the toner consumption amount is desirable from the standpoint of the energy required to fix the toner on the recording paper. Particularly in the image forming apparatus of an electrophotographic type used in an office, the reduction is important from the standpoint of energy saving.

On the other hand, the image forming apparatus of the electrophotographic type is used also in the printing-device field because of the progress in the digitalization and colorization. It is put into practice in the fields of the on-demand printing, graphic art, producing items such as a photograph or a poster, and a short-run printing device. The electrophotographic type is advantageous because of its on-demand property not using a proof. However, there still are points to be improved from the standpoint of a color reproduction region, a texture, an image quality stabilization property, suitability to media.

Such an improvement is required while reducing the cost, and therefore, the reduction of the toner consumption amount is important.

Japanese Laid-open Patent Application 2004-295144 discloses a low toner deposition amount system. Here, an absolute value of a charged potential of a photosensitive member is set as low as 350-550V, and toner having a high coloring power is deposited in the range of 0.3-0.7 mg/cm^2 so as to assure the image density on the recording paper after the fixing.

Japanese Laid-open Patent Application Hei 9-305058 discloses a control of the glossiness of the image which is influenced by the long term use of the fixing roller and/or the material of the recording sheets. Here, a heating temperature of a heating member is controlled on the basis of the density of a reference image read by a full-color sensor. By such a control, a target glossiness is provided.

However, in a low toner deposition amount system in which the toner consumption amount is small, the high glossiness can not been easily provided in a high density portion (solid portion), due to an unsmoothness of the paper fiber of the recording paper. The reason will be described referring to a case in which the toner deposition amount is large and the case in which the toner deposition amount is small. The toner height is larger in the large toner deposition amount case than in the small toner deposition amount case. Here, the toner deposition amount is the toner stacking amount per unit area, which will be simply called "toner deposition amount".

In order that the toner is fixed on the recording paper, the interface temperature between the toner and the recording paper is equal to or higher than a predetermined temperature.

A toner surface temperature is a temperature of the toner (on the recording paper) at the side contacting to a heating member such as a fixing (heating) roller.

Under the condition that the fixing properties are the same (the same interface temperatures), the toner surface temperature in the case of the small toner deposition amount is lower than that in the case of the large deposition amount. This is because when the toner deposition amount is small, the temperature of the heating member is made lower than in the case of large toner deposition amount. Therefore, in the case that the toner deposition amount is smaller, the toner on the surface (the toner on the side contacting the heating member) is less molten than in the case that the toner deposition amount is large, and therefore, the glossiness is low.

If the temperature of the heating member is raised in an attempt to enhance the glossiness with the small toner deposition amount, the toner on the surface (the toner on the side contacting to the heating member) is melted, but the interface temperature between the toner and the recording paper rises with the result of melting of the toner at the interface.

As a result, the toner soaks into the fibers of the recording paper with the result of decrease of the surface property of the toner. That is, the entirety of the toner image follows the unsmoothness knurled pits and projections of the fibers of the recording paper so that the surface of the toner image is influenced greatly by the unsmoothness knurled pits and projections of the fiber. For this reason, it is difficult to raise the glossiness of the high density portion in the low toner deposition amount system by simply raising the temperature of the heating member.

SUMMARY OF THE INVENTION

Accordingly, it is a principal object of the present invention to provide an image forming apparatus in which the glossiness of the image can be improved by suppressing soaking of the toner image into the fibers of the recording paper.

According to an aspect of the present invention, there is provided an image forming apparatus comprising an image forming device configured to form an unfixed toner image on a recording material; and a fixing device configured to fix the unfixed toner image onto the recording material into a fixing nip by heat and pressure. In an image forming process of the image forming device, $0<B<\rho\pi L/(30\times 3^{1/2})$ is satisfied, where L (μm) is the volume average particle size of toner of the unfixed toner image, ρ(g/cm^3) is the density of the toner, and B (mg/cm^2) is a maximum toner deposition amount, per unit area, on a predetermined recording paper. The fixing device fixes the toner image while satisfying the conditions that, at an outlet of the fixing nip, the viscosity of a toner layer contacting the fixing device is not higher than 1500 (Pa·s), and the viscosity of a toner layer contacting the recording paper is not lower than 3000 (Pa·s).

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The preferred embodiments of the present invention will be described in conjunction with the accompanying drawings. Here, the dimensions, the sizes, the materials, the configurations, the relative positional relationships of the elements in the following embodiments and examples are not restrictive to the present invention unless otherwise stated

First Embodiment

Referring to FIG. 1 to FIG. 16, a first embodiment of the present invention will be described. First, referring to FIG. 1, the general arrangement of an image forming apparatus will be described.

[Image Forming Apparatus]

The image forming apparatus is a full-color image forming apparatus of an electrophotographic type, and image forming stations (image forming devices) Pa, Pb, Pc, Pd, which are arranged along the rotational moving direction of an intermediary transfer belt 30 (tandem type). Each of the image forming stations Pa, Pb, Pc, Pd includes a photosensitive drum as an image bearing member (photosensitive member) 3*a*, 3*b*, 3*c*, 3*d*, respectively. Around the photosensitive drum 3*a*, 3*b*, 3*c*, 3*d*, a charger 2*a*, 2*b*, 2*c*, 2*d*, a developing device 1*a*, 1*b*, 1*c*, 1*d*, a primary transferring device 24*a*, 24*b*, 24*c*, 24*d*, and a cleaner 4*a*, 4*b*, 4*c*, 4*d* are respectively provided.

Figure 1:
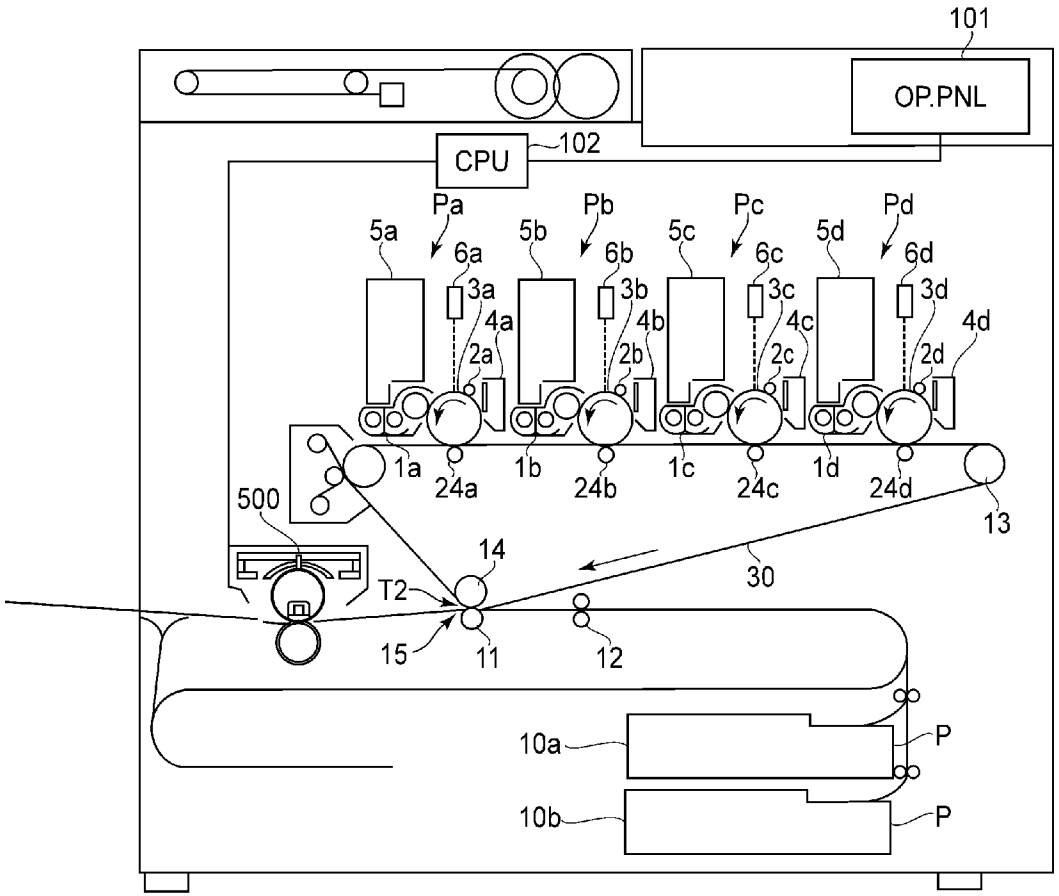
FIG. 1 is a schematic sectional view of an image forming apparatus according to a first embodiment of the present invention.

The upper part portion of the device includes an exposure device 6*a*, 6*b*, 6*c*, and 6*d* each having a light source device and a polygonal mirror. A surface of the photosensitive drum 3*a*, 3*b*, 3*c*, 3*d* charged by the charger 2*a*, 2*b*, 2*c*, 2*d* , respectively, is exposed to a laser beam so that an electrostatic latent image is formed. The laser beam emitted from the light source device is projected and deflected by a reflection mirror of the polygonal mirror. The deflected laser beam is condensed by an fθ lens on the charged photosensitive drum 3*a*, 3*b*, 3*c*, 3*d* and scans the drum along the generatrix of the drum so that an electrostatic latent image is formed on the photosensitive drum 3*a*, 3*b*, 3*c*, 3*d* in accordance with an image signal. In FIG. 1, the exposure device is schematically shown for simplicity.

The developing devices 1*a*, 1*b*, 1*c*, 1*d* contain yellow toner, magenta toner, cyan toner and black toner, respectively, as developers, in the state of being mixed with magnetic carriers, so that the toner and the carrier are circulated in the respective developing devices. The developing devices 1*a*, 1*b*, 1*c*, 1*d* develop the electrostatic latent images on the photosensitive drums 3*a*, 3*b*, 3*c*, 3*d* into a yellow toner image, a magenta toner image, a cyan toner image and a black toner image, respectively. In order to supply the toner corresponding to the consumption by the image formation, new toner is fed by a toner supplying device 5*a*, 5*b*, 5*c*, 5*d*.

An intermediary transfer belt (intermediary transfer member) 30 which is another image bearing member is rotated by a driving roller 13. The toner images thus formed on the photosensitive drums 3*a*, 3*b*, 3*c*, 3*d* are sequentially primary transferred onto the intermediary transfer belt 30 by application of the electric field or electric charge to a primary transferring device 24*a*, 23*b*, 23*c*, 24*d*, respectively. Thus, multi-color toner images (four colors) are overlaid on the intermediary transfer belt 30. That is, multi-color toner images are formed on the intermediary transfer belt 30 (image bearing member). In this embodiment, a toner image forming means is constituted by the photosensitive drum 3*a*, 3*b*, 3*c*, 3*d*, the charger 2*a*, 2*b*, 2*c*, 2*d*, the exposure device 6*a*, 6*b*, 6*c*, 6*d*, the developing device 1*a*, 1*b*, 1*c*, 1*d*, and the primary transferring device 24*a*, 24*b*, 24*c*, 24*d*.

The intermediary transfer belt 30 carrying four color toner images is fed to a secondary transfer portion T2. In the secondary transfer portion T2, there is provided a secondary transfer device 15 comprising an outer secondary transfer roller 11 and the inner secondary transfer roller 14. The outer secondary transfer roller 11 and the inner secondary transfer roller 14 support the intermediary transfer belt 30. The toner image on the intermediary transfer belt 30 is transferred onto the recording material P fed to the secondary transfer portion by the electric field or the charge applied between the rollers. In this embodiment, the secondary transfer device 15 is a transferring means for transferring the toner image from the image bearing member (intermediary transfer belt 30) onto the recording material (recording paper).

On the other hand, the recording material P is accommodated in the recording material cassettes 10*a*, 10*b*, from which the recording material P is fed to the secondary transfer portion T2 by feeding rollers and registration rollers 12. The toner image is transferred in a secondary transfer operation from the intermediary transfer belt 30 carrying the four color toner image in the secondary transfer portion T2 as described above, onto the recording material. The recording material having the transferred toner image is fed to a fixing device (fixing device) 500, which will be described hereinafter, so that the toner image is fixed on the recording material.

[Low Toner Deposition Amount System]

In the image forming apparatus of this example, a low toner deposition amount system is provided in which a toner deposition amount, per unit area, of the toner image formed on the recording material (toner deposition amount) is small. In this embodiment, the low toner deposition amount system is a system in which the image formation is carried out so that the toner deposition amount of a monochromatic toner of a solid image (monochromatic solid image) on the recording material is smaller than a predetermined amount.

Here, the monochromatic toner is one of yellow toner, magenta toner, cyan toner and black toner. In addition, the solid image is a toner image provided by developing a dot latent image of the maximum image density signal. In other words, the toner deposition amount of the solid image by monochromatic toner is the toner deposition amount of the maximum density yellow toner, magenta toner, cyan toner or black toner image. In the toner image providing the maximum density of a single color, the monochromatic toner deposition amount is the maximum.

As described above, when the toner deposition amount is smaller than a predetermined amount, it is a low toner deposition amount system, and therefore, the toner deposition amount of the toner image formed by the low toner deposition amount system is smaller than the toner deposition amount in a normal toner deposition amount system. Therefore, in this embodiment, the amount of the pigment in a toner particle is increased in order to suppress a reduction of the image density due to the smallness of the toner deposition amount of the monochromatic solid image on the recording material.

Figure 2:
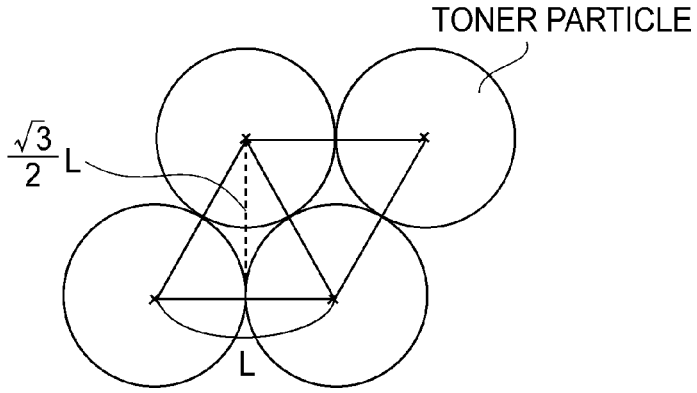
FIG. 2 illustrates an ideal arrangement of the toner particles.

A description will be provided as to the toner deposition amount of the monochromatic solid image on recording material when the toner particles are ideally arranged. As shown in FIG. 2, the honeycomb densest structure arrangement of the toner particles is the ideal arrangement state. Here, when the toner particles have a volume average particle size (diameter of the toner particle) L (μm), a volume of the toner particle is V (μm^3), a projected area S1 (μm^2) of the toner particle, and a unit area S2 (μm^2) including one toner particle are as follows: The unit area S2 containing one toner particle is a minimum area containing one toner particle in the honeycomb densest structure.

$$V = \frac{4}{3}\pi\left(\frac{L}{2}\right)^3 [\mu m^3] \quad \text{Formula 1}$$

$$S1 = \pi\left(\frac{L}{2}\right)^2 [\mu m^2] \quad \text{Formula 2}$$

$$S2 = \frac{\sqrt{3}}{2}L^2 [\mu m^2] \quad \text{Formula 3}$$

From them, a monolayer (one color) toner deposition amount H (μm) (toner volume (V/S2) per unit area=average height) densest arrangement of the toner particles is calculated as follows:

$$H = \frac{V}{S2} = \frac{4}{3}\pi\left(\frac{L}{2}\right)^3 \cdot \frac{2}{\sqrt{3}L^2} = \frac{\pi L}{3\sqrt{3}} [\mu m] \quad \text{Formula 4}$$

In the foregoing, in considering the arrangement of the toner particles, the monochromatic solid toner deposition amount on recording material is taken as the toner volume per unit area, that is, average height (μm). However, when the toner deposition amount is measured and controlled, a heavy per unit area [mg/cm^2] is normally used. Following this, the formula representing the above-described ideal arrangement (densest state of the spherical toner particles) is converted to the maximum toner deposition amount (monochromatic solid image) A (mg/cm^2) of the monochromatic toner image on the recording material, as follows. Here, 1/10 is required to equalize the units, and ρ (g/cm^3) is the density of the toner.

$$A = \rho \times H = \rho \times \frac{1}{10} \times \frac{\pi L^3}{3\sqrt{3}L^2} = \frac{\rho\pi L}{30\sqrt{3}} \quad \text{Formula 5}$$

The toner deposition amount A on the recording material of the monochromatic solid image in the formula is measured in the following manner. Yellow, magenta, cyan and black solid toner images of the maximum density are formed on the recording material on the recording material, respectively in the form of stripes of 100 mm×10 mm. Before the toner image is fixed on the recording material, the image forming apparatus is stopped to obtain unfixed toner images on the recording material.

Cylindrical filter paper (No. 86R available from TOYO ROSHI Kabushiki Kaisha, Japan, for example) which do not pass the toner but pass the air is fixed to a container having a suction opening of approx. 1 cm^2. While sucking from an opposite side opening, the cylindrical filter paper is placed close to the unfixed toner image stripe of 100 mm×10 mm on the recording material, and the unfixed toner image is sucked. The weight of the unfixed toner image on the cylindrical filter paper is measured using a precise balance. By doing so, the weight of the unfixed toner image on the recording material can be measured. Since the area of the toner image is 100 mm×10 mm, A can be measured by dividing the weight of the toner image by the image area.

In the case of this embodiment, the maximum toner deposition amount B of the monochromatic toner image formed by the toner image forming means on the recording material is made smaller than A ($=\rho\pi L/(30\times 3^{1/2})$. That is, it is a low toner deposition amount system in which the image formation is carried out under the condition that B<A is satisfied. Therefore, in this embodiment, the toner deposition amount B of the monochromatic solid image on recording material is as follows:

$$0 < B < \rho \times H = \rho \times \frac{1}{10} \times \frac{\pi L^3}{3\sqrt{3}L^2} = \frac{\rho\pi L}{30\sqrt{3}} \quad \text{Formula 6}$$

More specifically the toner has a volume average particle size L of 5.5 (μm) and a density ρ of 1.1 (g/cm^3), and the toner deposition amount B of the monochromatic solid image on the recording material is set to be 0.3 (mg/cm^2). The toner deposition amount B of the monochromatic solid image on recording material is made small for the purpose of energy conservation and cost reduction as described hereinbefore.

[Measuring Method for Volume Average Toner Particle Size]

A measuring method for the volume average toner particle size will be described. For the measurement of the volume average particle size of the toner, a Coulter counter multiple sizer II (available from Coulter Electronics Inc.) is used. The electrolytic solution is first class sodium chloride, and is aqueous solution of approx. 1% NaCl. As for the electrolytic solution, ISTON R-II (available from Coulter Scientific Japan KABUSHIKI KAISHA), for example can be suitably used.

In the measuring method, 0.1 ml of surfactant (alkylbenzenesulfonate preferably) is added as a dispersion material in 100 ml of the electrolytic solution, and in addition, a measured sample of 5 mg is added. The electrolytic solution suspending the sample is subjected to a dispersion process for about 3 minutes by an ultrasonic dispersing device, and using the above-described measuring device with a 100 μm aperture, the volumes and numbers of the toner having particle sizes of 2.00 to 40.30 μm are measured for each of the following channels. From the obtained toner volume distribution, the volume average toner particle size is calculated. The used channels are 2.00-2.52 μm; 2.52-3.17 μm; 3.17-4.00 μm; 4.00-5.04 μm; 5.04-6.35 μm; 6.35-8.00 μm; 8.00-10.08 μm; 10.08-12.70 μm; 12.70-16.00 μm; 16.00-20.20 μm; 20.20-25.40 μm; 25.40-32.00 μm; 32.00-40.30 μm (13 channels).

[Measuring Method for Density]

The measuring method for the density of the toner will be described. In this embodiment, a measuring method gas replacement type with helium is employed as a correct and simple method. The used measuring device is ACCUPIC 1330 (available from SHIMAZU SEISAKU SHO, Japan). The toner particles of 4 g before classification are placed in a cell of the stainless steel having an inner diameter of 18.5 mm, a length of 39.5 mm, and a capacity of 10 cm^3. The volume of the magnetic toner in the sample cell is measured by a pressure change of the helium gas, and the density of the toner particle before classification is determined from the determined volume and the weight of the sample.

[Fixing Device]

Figure 3:
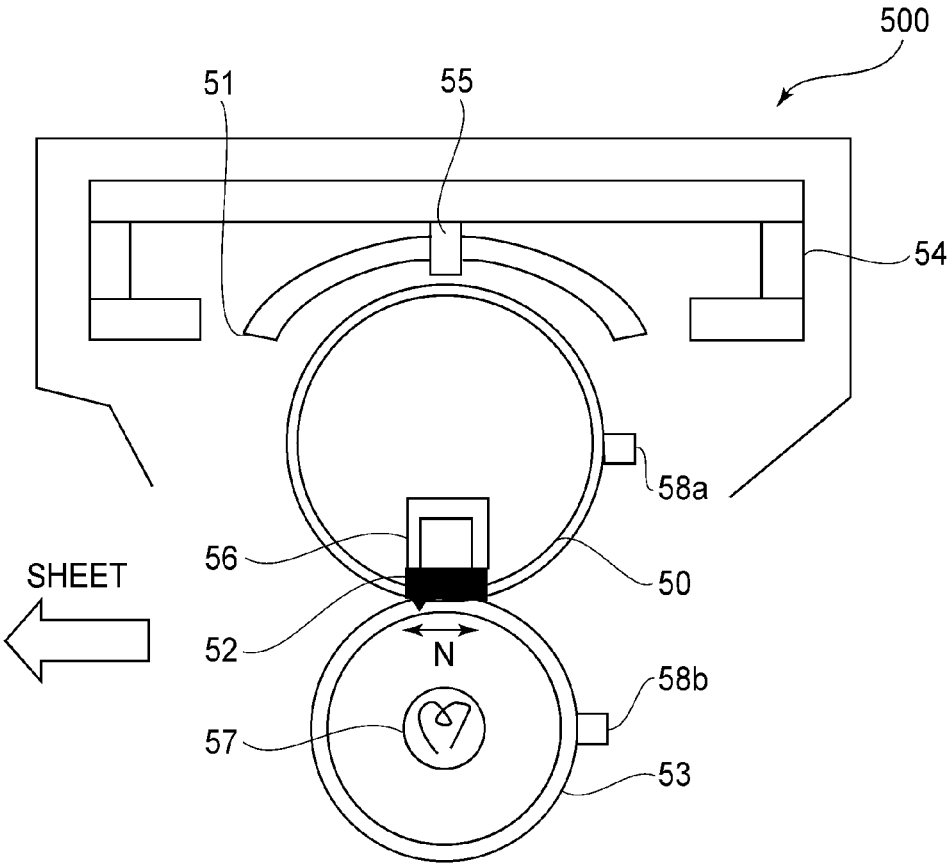
FIG. 3 is a substantial sectional view of a fixing device according to the first embodiment.

A description will be provided as to a fixing device 500. In this embodiment, the fixing device has a structure using a fixing belt in the form of film. As shown in FIG. 3, the fixing device 500 includes a fixing belt 50 as a fixing member, an IH coil 51, a pressing pad 52, a pressing roller 53 as a pressing member, a side core 54, a center core 55, and a pressing pad supporting member 56. In this embodiment, the use is made of a film heating fixing type that has the IH coil at a heat source, but the heat source may be a halogen heater (film heating fixing type).

The fixing belt 50 which is a first rotatable member has a three layer structure including a base layer, an elastic layer and a parting layer in the order named from the inner side toward the outer side. The fixing belt 50 has a diameter of 30 (mm), for example. The base layer is a heat generating metal layer for generating eddy current therein by an alternating magnetic field generated by the IH coil 51. The material thereof may be stainless steel, nickel as well as iron. The thickness thereof is preferably not less than 10 μm and not more than 100 μm, and in this embodiment it is 50 μm, for example. If it is not more than 10 μm, the durability as the fixing belt is poor, and the absorption of the electromagnetic energy is not enough with the result of low efficiency. If it is not less than 100 μm, the rigidity of the film is too high, and the flexibility is too poor to be practical.

The elastic layer is made of silicone rubber, which has good heat resistivity and heat conduction and which has a sufficiently low hardness. As other usable materials, there are fluorine-containing rubber, fluorosilicone rubber and the like. The thickness of the elastic layer is preferably 10-500 μm, and in this embodiment, it is 200 μm.

For the parting layer, fluorinated resin material (PFA) having high parting property and heat resistivity is preferable. Other usable materials include PTFE, FEP, silicone resin material, fluorine-containing rubber, silicone rubber and the like. The thickness thereof is desirably not less than 1 μm and not more than 100 μm, and in this embodiment, it is 50 μm. If it is not more than 1 μm, the toner-offset phenomenon may result due to wearing of the parting layer, and if it is not less than 100 μm, the heat generated by the heat generation layer cannot be transferred sufficiently to the recording material and toner with the result of improper fixing.

The pressing roller 53 is a second rotatable member and includes a metal core, and an elastic layer of silicone rubber or the like to reduce the hardness. In order to improve a surface property, a fluorinated resin material layer of the PFA is provided as an outer periphery. Inside the pressing roller 53, a halogen heater 57 is provided. The pressing roller 53 has a diameter of 30 (mm), for example. The pressing roller 53 contacts the fixing belt 50 to form a fixing nip N. In this embodiment, the fixing nip N is formed by being pressed by the pressing roller 53 through the pressing pad 52 and the fixing belt 50. The recording material having the transferred toner image passes through the fixing nip (press-contact portion) N, by which the toner image formed on the recording material is heated and pressed so that the toner image is fixed on the recording material.

The pressing pad 52 is made of a heat resistive engineering plastic resin material, and the surface has been subjected to a slide coating to enhance the slidability relative to the base layer metal of the fixing belt 50. The pressing pad supporting member 56 is made of a metal such as stainless steel or aluminum, and presses the pressing pad 52 toward the pressing roller 53 through the fixing belt 50.

The IH coil 51 is connected with an excitation circuit), and the circuit generates a high frequency current of 20 kHz to 500 kHz using a switching power source. A side core 54 and a center core 55 are made of ferromagnetic member such as ferrite, and a magnetic coupling by a magnetic field generated by the IH coil 51 is established. Particularly, a center core is provided at the center of the coil and a side core at the side surface so that the magnetic connection is enhanced.

In this embodiment, the film heating means uses the IH coil, but the heating of the film may be made by press-contacting a heating member from an outside of the film. The heating member may be a fixing roller having a heater therein. A total pressure of the fixing device 500 in this embodiment is 60 (kgf) (588≈600N), and a width of the fixing nip N is 9 (mm). A process speed of the image forming apparatus is 300 (mm/s) for example.

In this embodiment, to the surfaces of the fixing belt 50 and the pressing roller 53, thermisters 58*a*, 58*b* are contacted as a fixing detector and a pressing detector. The thermister 58*a* detects the surface temperature of the fixing belt 50, and the thermister 58*b* detects the surface temperature of the pressing roller 53, and on the basis of the detection results, the IH coil 51 or the halogen heater 57 is controlled to carry out the temperature control. In addition, in this embodiment, the CPU102 (FIGS. 1, 15) as the controller sets the surface temperature of fixing belt 50 and the surface temperature of pressing roller 53 as fixing conditions. The fixing condition will be described hereinafter.

[Relationship Between Surface Temperatures of Fixing Belt and Pressing Roller and Glossiness]

The relation between the surface temperatures of the fixing belt and the pressing roller, and the gloss in the low toner amount system will be described. During use of the image forming apparatus of this embodiment, a toner image was formed with the maximum toner deposition amount with different surface temperatures of the fixing belt 50 and different surface temperatures of the pressing roller 53. Table 1 shows the results of this experiment.

TABLE 1

| | Pressing roller temp. (° C.) | | | | | |
|---|---|---|---|---|---|---|
| Fixing belt temp. | 20 | 70 | 80 | 90 | 100 | 110 |
| 140 | N | N | N | N | N | N |
| 150 | Y | Y | Y | Y | Y | Y |
| 160 | Y | Y | Y | Y | Y | N |
| 170 | Y | Y | Y | Y | N | N |

The used recording material is CS814 and is available from Canon-Kabushiki Kaisha and has a basis weight of 81 (g/m^2). The temperatures in Table 1 are surface temperatures. The glossiness is measured (60° glossiness) using a device available from NIPPON DENSHOKU INDUSTRIES CO., LTD. In the Table, "Y" indicates that the glossiness is not less than 15, and "N" indicates that the glossiness is less than 15.

[Relationship Between Toner Surface Temperature and Interface Temperature, and Glossiness]

From Table 1, the surface temperature of the toner (upper layer toner temperature) contacted to the fixing belt 50 in the fixing nip N, and the interface temperature (lower layer toner temperature) between the toner and the recording material, that is, the toner contacting the recording material will be deduced.

Figure 4:
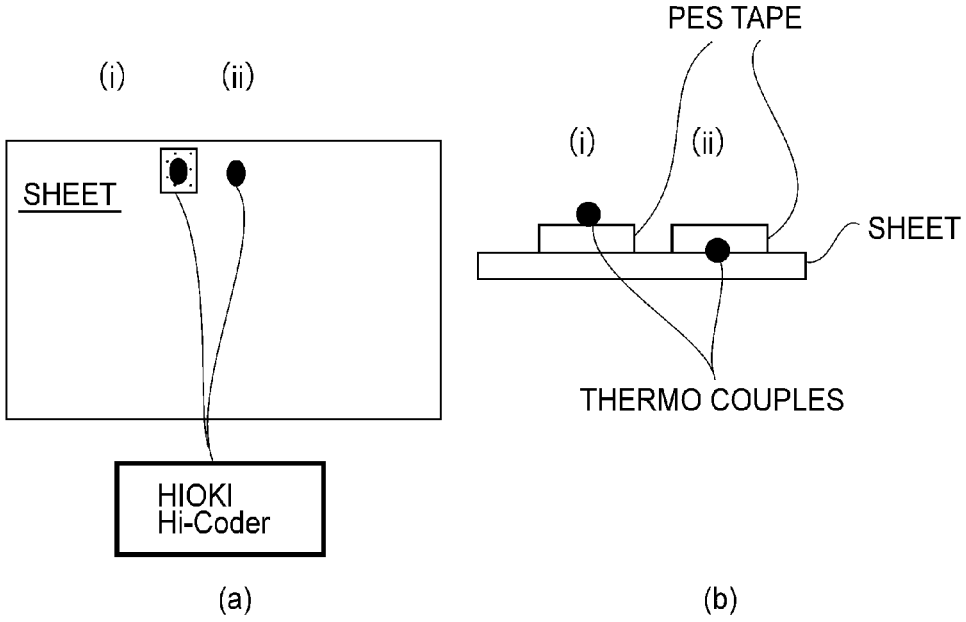
FIG. 4 is a top plan view (a) and a side view (b) illustrating a temperature measuring method for an upper layer toner and for a lower layer toner.

The temperature measurement was carried out as follows. Thermocouples (thin extrafine thermocouple KFST-10-100-200 available from Kabushiki Kaisha ANBESMT, Japan) are stuck on the CS814 recording material which is the same as the recording material used in the above-described experiment. As shown in FIG. 4, a polyester (PES) tape having a thickness of 10 (μm) is placed on the recording material with the thermocouple, wherein the tape is likened to the toner image having the maximum toner deposition amount. That is, the temperature of the upper surface of the PES tape corresponds to the surface temperature of the toner, and the temperature between the lower surface of the PES tape and the recording material corresponds to the interface temperature. More particularly, part (i) in FIG. 4 is likened to the measurement of toner surface temperature. And, part (ii) of FIG. 4 is likened to the measurement of the interface temperature between the toner and the recording material.

Such a recording material is processed through the fixing nip N of the fixing device 500, and the temperature in the fixing nip is measured. For data analysis, a Memory Hi-Coder 8855 available from HIOKI Kabushiki Kaisha, Japan was used.

Figure 5:
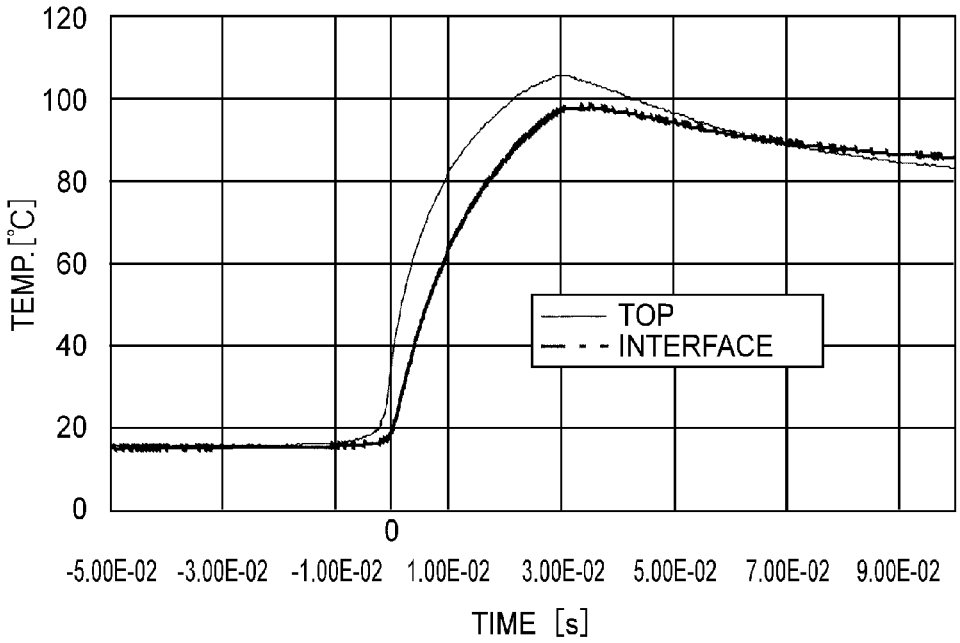
FIG. 5 shows results of measurement of the temperature of the fixing nip, using the method of FIG. 4.

FIG. 5 shows the results of the temperature sensing when the temperature control is effected so that the surface temperature of the fixing belt 50 is 160 degC, and the surface temperature of the pressing roller 53 is 80 degC. The abscissa represents time, and the ordinate represents the measured temperature by the thermocouple. The solid line is the upper surface temperature of the PES tape, and the broken line is the temperature between the PES tape and the recording material. The duration for time 0 to time 30 (ms) is the duration in which the tape is in the fixing nip N.

As will be understood from FIG. 5, the measured temperatures rise toward the outlet of the fixing nip N, and the temperatures are the maximum at the nip outlet. In FIG. 5, the toner surface temperature at the outlet of the fixing nip N is 107 degC, and the interface temperature between the toner and the recording material there is 97 degC.

Table 2 and Table 3 show the toner surface temperature (upper layer toner temperature) at the outlet of the fixing nip N and the interface temperature the lower layer toner temperature) when the surface temperatures of the fixing belt 50 and the pressing roller 53 are changed.

The toner surface temperature here is the thermocouple temperature on the top of the PES tape shown in FIG. 4, and the interface temperature is the thermocouple temperature between the recording material and the PES tape shown in FIG. 4. The outlet of the fixing nip N is the position where the upper surface temperature of the PES tape is the maximum temperature in FIG. 5. In the case that the toner surface temperature and the interface temperature at the outlet of the fixing nip is measured in another fixing device, a recording material on which the PES tape and the thermocouples are fixed is passed through the another recording material fixing device. The toner surface temperature at the position of the maximum temperature in the temperature graph of the upper surface of the PES tape shown in FIG. 5 is measured, and the interface temperature at the instance when the toner surface temperature occurs is measured.

TABLE 2

(toner surface temperature)

| | Pressing roller temp. (° C.) | | | | | |
|---|---|---|---|---|---|---|
| Fixing belt temp. | 20 | 70 | 80 | 90 | 100 | 110 |
| 140 | 105 | 105 | 105 | 105 | 105 | 105 |
| 150 | 106 | 106 | 106 | 106 | 106 | 106 |
| 160 | 107 | 107 | 107 | 107 | 107 | 107 |
| 170 | 108 | 108 | 108 | 108 | 108 | 108 |

TABLE 3

(interface temperature)

| | Pressing roller temp. (° C.) | | | | | |
|---|---|---|---|---|---|---|
| Fixing belt temp. | 20 | 70 | 80 | 90 | 100 | 110 |
| 40 | 92 | 94 | 95 | 96 | 97 | 98 |
| 150 | 93 | 95 | 96 | 97 | 98 | 99 |
| 160 | 94 | 96 | 97 | 98 | 99 | 100 |
| 170 | 95 | 97 | 98 | 99 | 100 | 101 |

From Table 2 and Table 3 in the light of Table 1, it is understood that the glossiness is high when the toner surface temperature is higher than 105 degC, and the interface temperature is lower than 100 degC, at the outlet of the fixing nip N.

Figure 6:
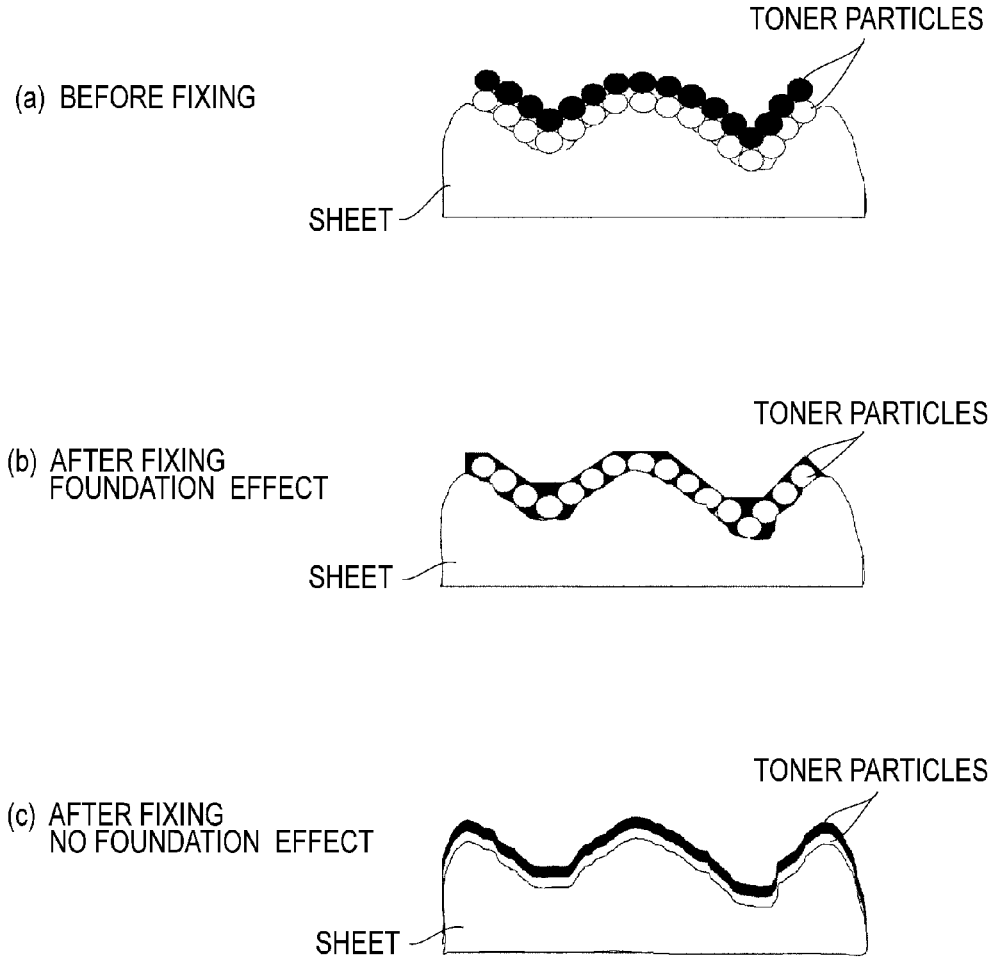
FIG. 6 is schematic views illustrating a foundation effect wherein (a) shows an unfixed state of the toner, (b) shows a foundation effect after the fixing, and (c) shows the case of no foundation effect after the fixing.
Figure 7:
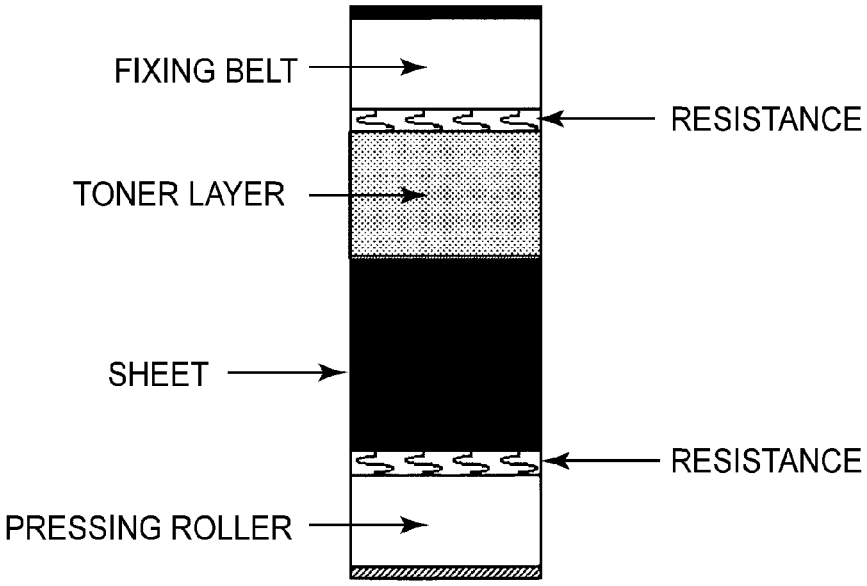
FIG. 7 shows a simulation model for calculating a temperature distribution of the toner layer and the recording material.

The reason why the glossiness is high when the toner surface temperature and the interface temperature are at such levels will be described. When the toner surface temperature of and the interface temperature between the toner and the recording material are at such levels, the upper layer surface side of the toner (front side, upper layer toner) is melted, but the lower layer surface side of the toner the recording material side, lower layer toner) is not greatly melted. Such a state is called here the "foundation effect". Referring to FIG. 6, the foundation effect will be described in detail.

[Foundation Effect]

As shown in part (a) of FIG. 6 (toner unfixed state), the lower layer toner is below a height of 5-6 (μm) from the surface of the recording material, which corresponds to one toner particle, and the upper layer toner is the layer on and above the lower layer toner. The lower layer toner is the first color toner image formed by the upstream image forming station (Pa, for example), and the upper layer toner is the second color toner image formed by a downstream image forming station (Pb, for example). Thus, in the low toner amount system of this embodiment, the toner deposition amount of the monochromatic solid image corresponds substantially to one toner particle. Therefore, when two color images are formed with the respective maximum densities, the height of the formed toner image corresponds to two toner particles at the maximum.

As will be described hereinafter, in the image forming apparatus of this embodiment, even when a three color or a four color toner image is formed, the maximum toner deposition amount is twice the toner deposition amount of the monochromatic solid image. Therefore, when a multi-color (not less than three colors) toner image is formed, the height of the toner image corresponds substantially to two toner particles as shown in part (a) of FIG. 6.

Here, the foundation effect is a phenomenon in which the lower layer toner is not melted greatly so that the particle shapes remain, and the upper layer toner is melted to fill the gaps between and among the particle shapes, by which the surface property of the toner is enhanced so that the glossiness is enhanced. Such a state is shown in part (b) of FIG. 6.

Without the foundation effect as shown in part (c) of FIG. 6, on the contrary, the lower layer toner is greatly melted such that the lower layer toner follows the unsmoothness of the fibers, and the upper layer toner followings the lower layer toner in the unsmoothness. As a result, the surface property of the surface of the toner cannot be enhanced with the result of low glossiness.

Such a foundation-effect phenomenon will be described further, using simulation. The simulation is made with a calculation on the basis of a model of FIG. 7, using one-dimension heat conduction analysis solver with a differential method.

For the simulation, the following values are set. A thermal conductivity of the toner layer is 1.5×10^-4 (W/mmK), a specific heat thereof is 1.0 (J/gK), a thermal conductivity of the recording material is 1.5×10^-4 (W/mmK), a specific heat thereof is 1500 (J/kgK), and a contact thermal resistance is 3.1×10^-3 (W/mm^2K). An initial temperatures of the recording material and the toner layer are 23 degC. The thermal capacity of the paper (recording material) is that of the CS-814 paper available from Canon-Kabushiki Kaisha, Japan.

In the low toner deposition amount system, the toner height is 12 (μm), and in the normal toner deposition amount system, the toner height is 24 (μm), in the calculation. These values correspond to the heights of the toner on the recording material having the transferred toner image at the maximum toner deposition amount.

In the low toner deposition amount system of the image forming apparatus of this embodiment, the used toner has a volume average toner particle size of 5.5 (μm), and a density of 1.1 (g/cm^3). The maximum toner deposition amount (toner deposition amount of the monochromatic solid image) of the monochromatic toner image per unit area on the recording material is 0.3 (mg/cm^2), and the maximum toner deposition amount of the multi-color toner image per unit area on the recording material is 0.6 (mg/cm^2). That is, in this embodiment, the maximum toner deposition amount, per unit area, of the multi-color toner image formed by the toner image forming means on the recording material is set to be twice the maximum toner deposition amount, per unit area, of the monochromatic toner image on the recording material. In other words, the maximum toner deposition amount of the toner image which can be formed on the recording material is set to be twice the toner deposition amount of the monochromatic solid image. Therefore, the apparatus is set such that even when three color or four color image is outputted, the maximum toner deposition amount on the recording material is 0.6 (mg/cm^2).

On the other hand, also in the toner deposition amount system of the normal image forming apparatus, the toner having a volume average toner particle size of 5.5 (μm) and a density of 1.1 (g/cm^3) is used. However, the maximum toner deposition amount, per unit area, of the monochromatic toner image on the recording material is 0.6 (mg/cm^2), and the maximum toner deposition amount, per unit area, on the recording material of the multi-color toner image is 1.2 (mg/cm^2). That is, in the normal toner deposition amount system, the toner deposition amount of the monochromatic solid image and the maximum toner deposition amount of the multi-color toner image are twice those of the low toner deposition amount system. For such a normal toner deposition amount system, the maximum toner deposition amount on the recording material is set to be twice the toner deposition amount of the monochromatic solid image. Therefore, the apparatus is set such that even when three color or four color image is outputted, the maximum toner deposition amount on the recording material is 1.2 (mg/cm^2).

Figure 8:
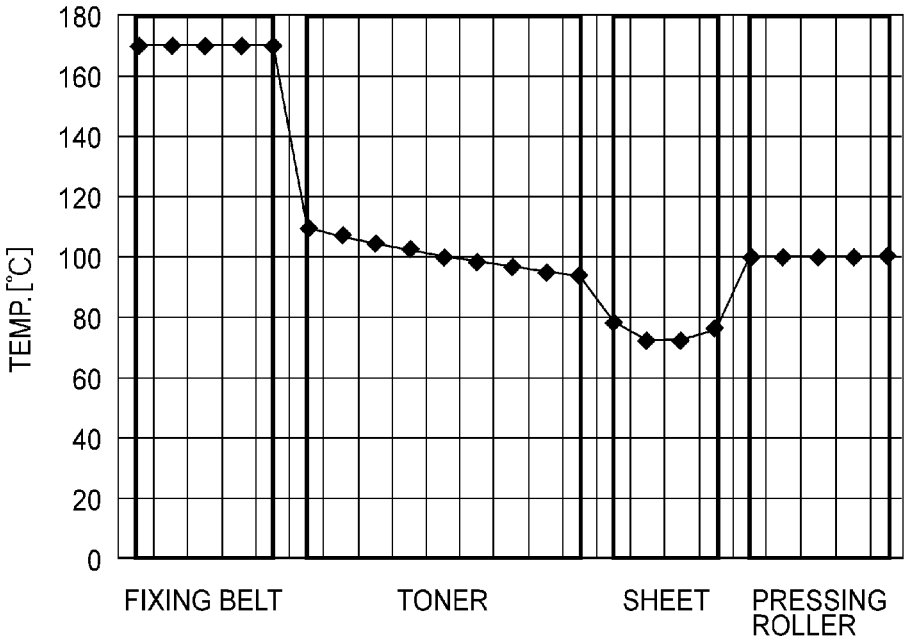
FIG. 8 shows a calculation result of the temperature distributions of various parts in the case that the toner deposition amount is large.

FIG. 8 is a temperature distribution at the outlet of the fixing nip extending from the fixing belt to the pressing roller, when the surface temperature of fixing belt is set at 170 degC, and the surface temperature of pressing roller is set at 100 degC, in the normal toner deposition amount system with which the toner deposition amount is large. The ordinate of FIG. 8 represents the calculation result temperature, and the abscissa represents positions of various parts. More particularly, they are the fixing belt portion, the toner portion, the recording material portion and the pressing roller portion from the left side. The calculation of the temperature of the toner portion was made at 3 μm intervals, for high calculation accuracy. The calculation of the recording material portion was made at 25 μm intervals.

As shown in FIG. 8, in the upper layer toner (neighborhood of the fixing belt), the temperature is 110 degC, and in the lower layer toner (neighborhood of the recording material), the temperature is 94 degC. Therefore, the upper layer toner is melted, and the lower layer toner is not so melted, so that the foundation effect works. Therefore, in the case of the normal toner deposition amount system, the glossiness can be enhanced with such settings of the temperatures of the fixing belt and the pressing roller.

Figure 9:
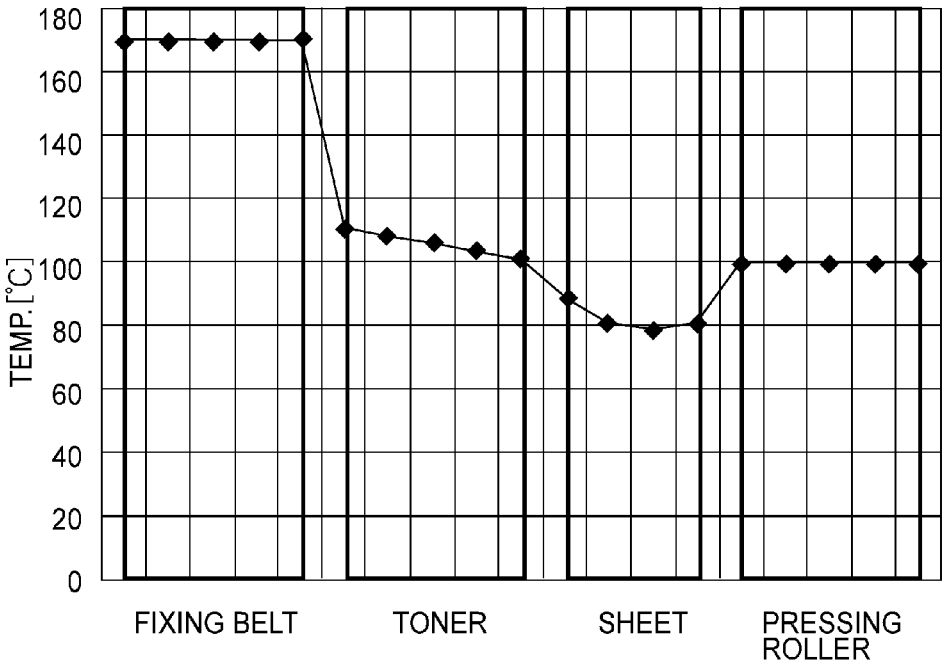
FIG. 9 shows a calculation result of the temperature distributions of each portion when the toner deposition amount is small.

FIG. 9 shows a temperature distribution at the outlet of the fixing nip extending from the fixing belt to the pressing roller, when the surface temperature of the fixing belt is set at the 170 degC, and the surface temperature of the pressing roller is set at the 100 degC in the low toner deposition amount system with which the toner deposition amount is small. The ordinate of FIG. 9 represents the calculation result temperature, and the abscissa represents the positions of various parts. More particularly, they are the fixing belt portion, the toner portion, the recording material portion and the pressing roller portion from the left side. The calculation of the temperature of the toner portion was made at 3 μm intervals, for high calculation accuracy. The calculation of the recording material portion was made at 25 μm intervals.

The area (width in the abscissa) of the toner portion in FIG. 9 is smaller than that in FIG. 8 because of the difference in the toner deposition amount. From the results of FIG. 9, in the upper layer toner (adjacent to the fixing belt), the temperature is 110 degC, and in the lower layer toner (adjacent to the recording material), the temperature is 100 degC. Therefore, from Table 1 and Table 3, the lower layer toner is melted so greatly that the foundation effect does not appear, and therefore, the glossiness is not enhanced.

Figure 10:
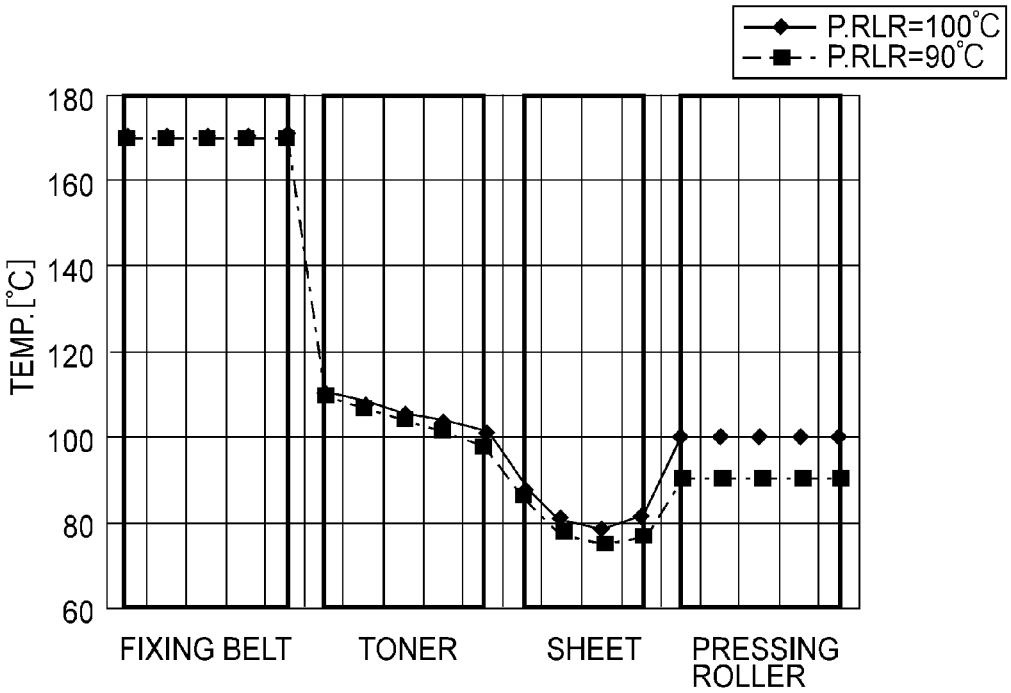
FIG. 10 shows a calculation result of the temperature distributions of each portion when the surface temperature of the pressing roller is changed.

FIG. 10 is a temperature distribution at outlet of the fixing nip extending from the fixing belt to the pressing roller, when the surface temperature of fixing belt is set at 170 degC, and the surface temperature of pressing roller is set at 90 degC and 100 degC, in the low toner deposition amount system with which the toner deposition amount is small. The ordinate of FIG. 10 represents the calculation result temperature, and the abscissa represents positions of various parts. More particularly, they are the fixing belt portion, the toner portion, the recording material portion and the pressing roller portion from the left side. The calculation of the temperature of the toner portion was made at 3 μm intervals, for high calculation accuracy. The calculation of the recording material portion was made at 25 μm intervals.

From the result of FIG. 10, in the upper layer toner (adjacent to the fixing belt), the temperature is 110 degC. On the other hand, in the lower layer toner (adjacent to the recording material), the temperature is 100 degC when the surface temperature of the pressing roller is 100 degC, and is lower than 100 degC when the surface temperature of the pressing roller is 90 degC. Therefore, from Table 1 and Table 3, when the surface temperature of the pressing roller is 100 degC, the lower layer toner is melted so greatly that the foundation effect does not appear, and therefore, the glossiness cannot be enhanced. However, when the surface temperature of the pressing roller is 90 degC, the lower layer toner temperature is lower than 100 degC, so that the lower layer toner is not melted so greatly, and therefore, the foundation effect works, by which the glossiness can be enhanced.

Figure 11:
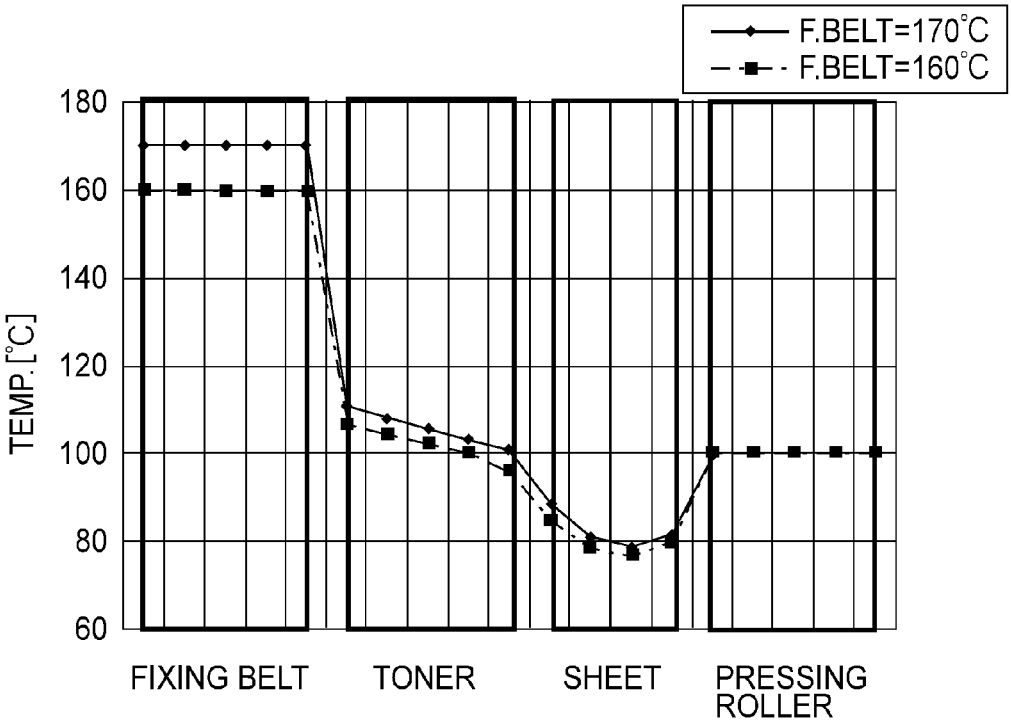
FIG. 11 shows a calculation result of the temperature distributions of each portion when the surface temperature of fixing belt is changed.

FIG. 11 shows a temperature distribution at the outlet of the fixing nip extending from the fixing belt to the pressing roller in the case that the surface temperature of fixing belt is set at 160 degC and 170 degC, and the surface temperature of pressing roller is 100 degC, in the low toner deposition amount system with which the toner deposition amount is small. The ordinate of FIG. 11 represents the calculation result temperature, and the abscissa represents positions of various parts. More particularly, they are the fixing belt portion, the toner portion, the recording material portion and the pressing roller portion from the left side. The calculation of the temperature of the toner portion was made at 3 μm intervals, for high calculation accuracy. The calculation of the recording material portion was made at 25 μm intervals.

From the results of FIG. 11, in the upper layer toner (adjacent to the fixing belt), the temperature is 110 degC when the surface temperature of the fixing belt is 170 degC, and is the temperature is 107 degC when the surface temperature of the fixing belt is 160 degC. In the lower layer toner (adjacent to the recording material), the temperature is 100 degC when the surface temperature of the fixing belt is 170 degC, and the temperature is lower than 100 degC when the surface temperature of the fixing belt is 160 degC. Therefore, from Table 1 and Table 3, in the case of the 170 degC temperature control for the fixing belt surface temperature, the lower layer toner is melted so greatly that the foundation effect does not work, and therefore, the glossiness is not enhanced. However, when the surface temperature of the fixing belt is 160 degC, the lower layer toner temperature is lower than 100 degC, and the lower layer toner does not melt so greatly, and therefore, the foundation effect works, by which the glossiness can be enhanced. Here, also when the fixing belt surface temperature is 160 degC, the upper layer toner temperature is higher than 105 degC, and therefore, the toner is melted.

Next, the calculation results when is basis weight of the recording material is changed. The calculation condition for the recording material having the basis weight of 68 (g/m^2) is that the thermal conductivity is 1.5×10^-4 (W/mmK), the specific heat is 1500 (J/kgK), and the recording material thickness is 68 (μm). The calculation condition for the recording material having the basis weight of 80 (g/m^2) is that the thermal conductivity is 1.5×10^-4 (W/mmK), the specific heat is 1500 (J/kgK), and the recording material thickness is 80 (μm). The calculation condition for the recording material having the basis weight of 105 (g/m^2) is that the thermal conductivity is 1.5×10^-4 (W/mmK), the specific heat is 1500 (J/kgK), and the recording material thickness is 105 (μm).

Figure 12:
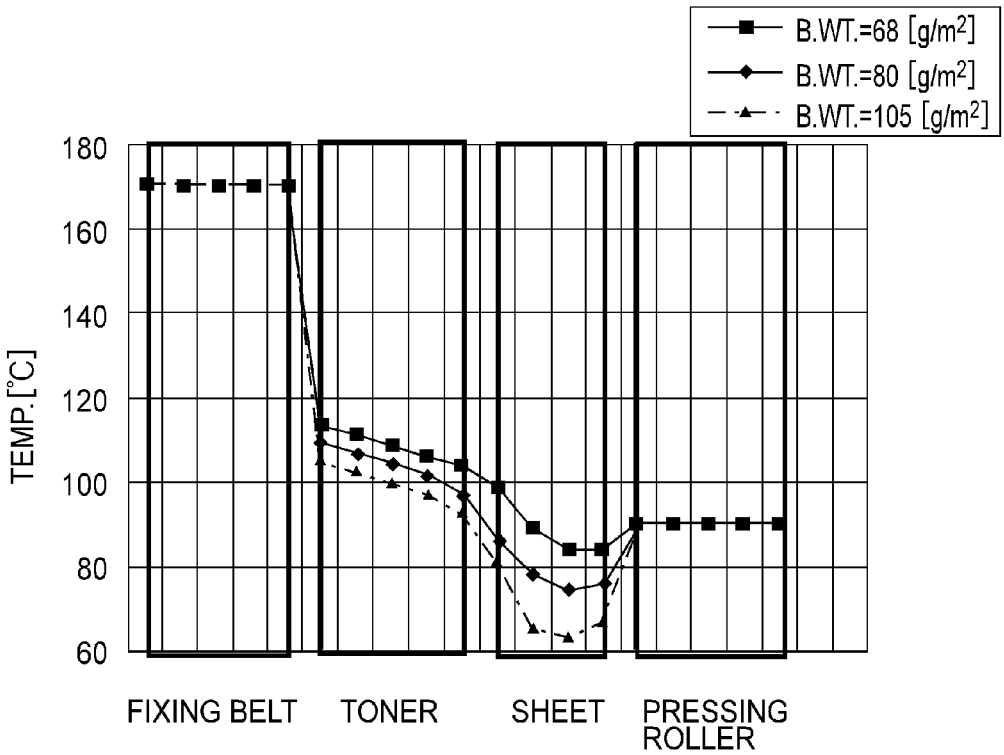
FIG. 12 shows a calculation result of the temperature distributions of each portion when the kind of the recording material is changed.

FIG. 12 is a temperature distribution at the outlet of the fixing nip extending from the fixing belt to the pressing roller when the surface temperature of fixing belt is set at 170 degC, and the surface temperature of pressing roller is set at 90 degC in the low toner deposition amount system, using recording materials having different basis weights. The ordinate of FIG. 12 represents the calculation result temperature, and the abscissa represents positions of various parts. More particularly, they are the fixing belt portion, the toner portion, the recording material portion and the pressing roller portion from the left side. The calculation of the temperature of the toner portion was made at 3 μm intervals, for high calculation accuracy. For the recording material portion, the calculation is made with the intervals of 20 μm when the basis weight is 68 (g/m^2), and with the intervals of 25 μm when the basis weight is 80 (g/m^2), and with the intervals of 35 μm when the basis weight is 105 (g/m^2).

From the results of FIG. 12, the temperature of the upper layer toner (adjacent to the fixing belt) is higher than 105 degC with any of the recording materials. On the other hand, the temperature in the lower layer toner (adjacent to the recording material) is lower from 100 degC if the basis weight of the recording material is not less than 80 (g/m^2). However, when the basis weight of the recording material is 68 (g/m^2), the temperature of the lower layer toner is 104 degC. Therefore, if the basis weight of the recording material is not less than 80 (g/m^2) under the above-described fixing conditions, the lower layer toner does not melt so greatly, and therefore, the foundation effect works, and therefore, the glossiness can be enhanced. However, with the basis weight of 68 (g/m^2), the lower layer toner melts too much, with the result that the foundation effect does not work, and therefore, the glossiness cannot be enhanced.

Table 4 shows a relationship between different surface temperatures of the fixing belt and different surface temperatures of the pressing roller and the gloss, when CS-680 thin paper sheet (available from Canon-Kabushiki Kaisha) having a basis weight of 68 (g/m^2) is used.

TABLE 4

| | Pressing roller temp. (° C.) | | | | | |
|---|---|---|---|---|---|---|
| Fixing belt temp. | 20 | 70 | 80 | 90 | 100 | 110 |
| 150 | Y | Y | Y | Y | N | N |
| 160 | Y | Y | Y | N | N | N |
| 170 | Y | Y | N | N | N | N |

The glossiness is measured (60° glossiness) using a device available from NIPPON DENSHOKU INDUSTRIES CO., LTD. In the Table, "Y" indicates that the glossiness is not less than 15, and "N" indicates that the glossiness is not more than 15.

[Relationship Between Temperature and Heated Toner Viscosity]

Figure 13:
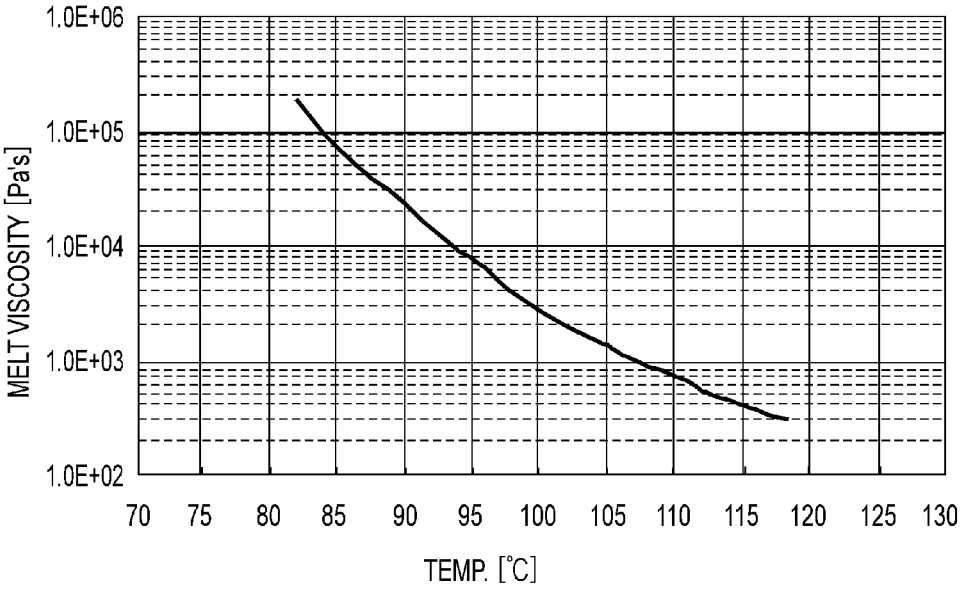
FIG. 13 shows a measurement result of a viscosity of the heated toner, relative to a temperature.

Next, the relationship between the temperature and the heated toner viscosity will be described. FIG. 13 is a graph of a viscosity property of the toner used in this embodiment measured by a flow tester. The toner viscosity was measured by a flow tester CFT-500D available from Kabushiki Kaisha SHIMAZU SEISAKUSHO, Japan under the following conditions in accordance with the operation manual thereof.

Sample: 1.0 g of the toner is placed in a pressure molding having a diameter of 1 cm and is pressed for one minute under the load of 20 kN so that it is molded, and is used as a sample.

Die hole diameter: 1.0 mm.

Length: 1.0 mm.

Cylinder pressure: 9.807×10ˆ5 (Pa).

Measuring mode: temperature raising method with the temperature rising speed of 4.0 degC/min.

With this method, the viscosities (Pa·s) of the toner at the 50 degC to 200 degC are measured. From the graph of FIG. 13, it is understood that by raising the temperature, the toner viscosity decreases. When the viscosity decreases the toner particle is easily deformed.

As described above referring to Tables 1, 2 and 3, when the toner image is formed with the maximum toner deposition amount in the low toner deposition amount system of this embodiment, the conditions for the high glossiness of the image are as follows. The glossiness is high when the toner surface temperature is higher than 105 degC, and the interface temperature is lower from 100 degC, at the outlet of the fixing nip N.

From the results of the measurement of the flow tester shown in FIG. 13, when the temperature is higher than 105 degC, the toner viscosity is not higher than 1500 (Pa·s). On the other hand, when the temperature is lower than 100 degC, the toner viscosity is not lower than 3000 (Pa·s). Therefore, it is understood that the condition for the high glossiness is that the viscosity of the toner contacting the fixing belt is not higher than 1500 (Pa·s) and that the viscosity of the toner contacting the recording material is not less than 3000 (Pa·s).

That is, it is understood from Tables 1, 2 and 3 that when the toner surface temperature is not more than 105 degC, the glossiness is low, and therefore, when the viscosity of the upper layer toner contacting the fixing belt is higher than 1500 (Pa·s), the glossiness is low. On the other hand, it is understood from Tables 1, 2 and 3 that when the toner interface temperature is not lower than 100 degC, the glossiness is low, and therefore, when the viscosity of the toner contacting the recording material is lower than 3000 (Pa·s), the gloss is low. Therefore, in order to enhance the glossiness, the toner viscosity is to be in such a range.

The viscosity of the toner is an index indicative of easiness of toner melting, and therefore, the range applies irrespective of the kind of the toner. That is, the glossiness can be made high if the range is satisfied, for any toner. The thickness of the toner image is not limited to the above-described two layer structure. That is, when the toner image is formed with the maximum toner deposition amount in the low toner deposition amount system, the fixing condition may be set in accordance with the thickness of the toner image such that the toner viscosity is within the above-described range.

Figure 14:
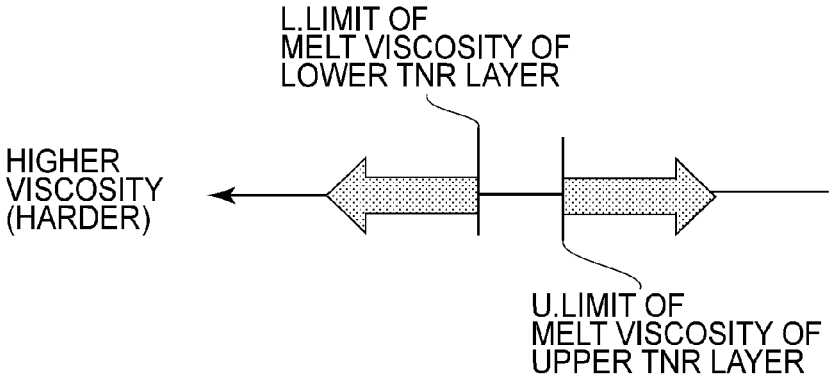
FIG. 14 is a schematic view illustrating a range of the viscosities of the heated upper layer toner and the heated lower layer toner.

Referring to FIG. 14, the range of the toner viscosity will be described in detail. FIG. 14 illustrates the range of the viscosity of the upper layer toner and the lower layer toner on the viscosity axis. The lower layer toner is in the range up to the height of 5-6 (μm) which corresponds to one toner particle, from the surface of the recording material, and the upper layer toner on and above the lower layer toner. The toner height on the recording material is determined by observing the toner layer using a color 3D configuration measuring microscope of an ultra deep type available from Kabushiki Kaisha KEYENCE, Japan.

The lower limit of the viscosity of the lower layer toner is determined by the foundation effect. When the viscosity of the lower layer toner is lower than the lower limit, the lower layer toner melts too much with the result that the melted toner follows the fibers of the recording material, and therefore, the foundation effect described in conjunction with FIG. 6 does not work. On the other hand, the upper limit of the viscosity of the upper layer toner is determined by the melting of the toner. When the viscosity of the upper layer toner is not lower than the upper limit, the melting of the toner is not enough to make the surface of the upper layer toner flat, and therefore, the glossiness is not high.

Actually, however, the ranges of the viscosities of the upper layer toner and the lower layer toner are determined taking into consideration the fixing property of the fixing device 500 and the hot offset of the toner. Specifically, it is preferable that the viscosity of the toner contacting the fixing belt is not lower than 100 (Pa·s) in consideration of the hot offset. The viscosity of the heated toner contacting the recording material is preferably not higher than 100000 (Pa·s) in consideration of the fixing property. Therefore, the preferable range of the viscosity of the heated toner is not lower than 100 (Pa·s) and not higher than 1500 (Pa·s), for the toner contacting the fixing belt, and is not lower than 3000 (Pa·s) and not higher than 100000 (Pa·s), for the toner contacting the recording material. The preferable range of the viscosities of the upper layer toner and the lower layer toner for the glossiness enhancement, the good fixing property and the prevention of the hot offset is the same irrespective of the kind of the toner. Here, "melting" is not restricted to the actual melting state, but includes the softened state, in this specification, as will be understood from the above-described viscosity ranges and FIG. 14.

[Control of Fixing Device]

The control of the fixing device 500 of this embodiment will be described. As described hereinbefore, the used toner has a volume average particle size 5.5 (μm), and a density of 1.1 (g/cmˆ3). The toner deposition amount of the monochromatic solid image on the recording material is 0.3 (mg/cmˆ2), and the maximum toner deposition amount on the recording material is 0.6 (mg/cmˆ2). The maximum toner deposition amount on the recording material is set to be twice the toner deposition amount of the monochromatic solid image. Even when a three color or four color image is outputted, the maximum toner deposition amount is set to be 0.6 (mg/cmˆ2).

In order to place the viscosities of the upper layer toner and the lower layer toner in the above-described range, the surface temperature of the fixing belt is controlled to be 160 degC, and the surface temperature of the pressing roller is controlled to be 80 degC (temperature control, fixing condition), for the recording material having a basis weight not less than 80 (g/m^2). On the other hand, the surface temperature of the fixing belt is controlled to be 150 degC, and the surface temperature of the pressing roller is controlled to be 70 degC (temperature control, fixing condition).

Figure 15:
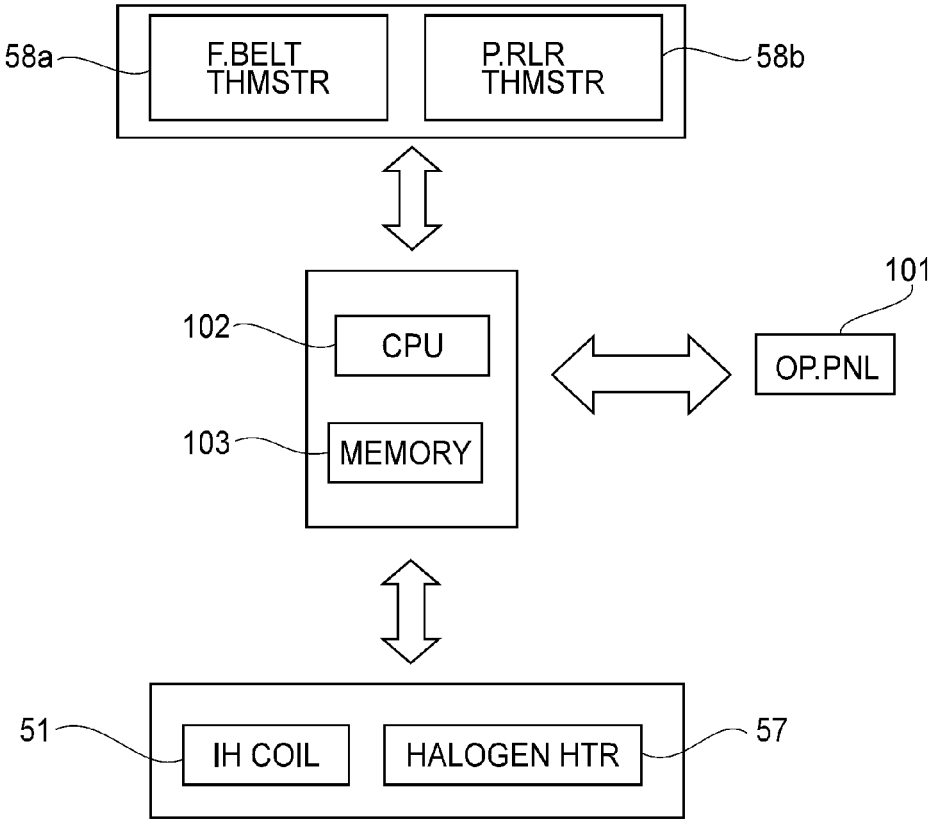
FIG. 15 is a control block diagram of the fixing device in the first embodiment.

Referring to FIG. 15 together with FIGS. 1 and 3, such a temperature control will be described. First, the user designates a kind of the recording material in an operating portion 101. The information is transferred to the CPU102, which discriminates whether or not the basis weight of the recording material is not less than 80 (g/m^2), referring to memory 103.

The surface temperatures of the fixing belt 50 and the pressing roller 53 are detected by the thermister 58*a* for the fixing belt and the pressing roller for the thermister 58*b*, and the detection results are transferred to the CPU102. When the basis weight of the recording material is not less than 80 (g/m^2), and the surface temperature of the fixing belt 50 is less than 160 degC, a current is applied to the IH coil 51 to heat the fixing belt 50 until the surface temperature of the fixing belt 50 becomes 160 degC. On the other hand, when the surface temperature of the fixing belt 50 is not less than 160 degC, the current is not applied to the IH coil 51. When the surface temperature of the fixing belt 50 becomes not less than 170 degC (10 degC or more higher than the set temperature), the fixing belt 50 is rotated idly until the surface temperature of the fixing belt 50 becomes less than 170 degC (160 degC which is the set temperature, for example) to cool it down.

If surface temperature of the pressing roller 53 is less than 80 degC, the halogen heater 57 is lighted by being turned on, until the surface temperature of the pressing roller 53 becomes 80 degC to heat the pressing roller 53. If the surface temperature of the pressing roller 53 is not less than 80 degC, the halogen heater 57 is not lighted, i.e. it is turned off. When the surface temperature of the pressing roller 53 becomes not less than 90 degC (10 degC or more above the set temperature), the pressing roller 53 is rotated idly to cool it down until the surface temperature of the pressing roller 53 becomes less than 90 degC (80 degC which is the set temperature, for example).

On the other hand, when the basis weight of the recording material is less than 80 (g/m^2), and the surface temperature of the fixing belt 50 is less than 150 degC, the current is applied to the IH coil 51 to heat the fixing belt 50 until the surface temperature of the fixing belt 50 becomes 150 degC. On the other hand, when the surface temperature of the fixing belt 50 is not less than 150 degC, the current is not applied to the IH coil 51. When the surface temperature of the fixing belt 50 becomes not less than 160 degC (10 degC or more higher than the set temperature), the fixing belt 50 is rotated idly until the surface temperature of the fixing belt 50 becomes less than 160 degC (150 degC which is the set temperature, for example) to cool it down.

If surface temperature of the pressing roller 53 is less than 70 degC, the halogen heater 57 is lighted and turned on until the surface temperature of the pressing roller 53 becomes 70 degC to heat the pressing roller 53. If the surface temperature of the pressing roller 53 is not less than 70 degC, the halogen heater 57 is not lighted, i.e., it is turned off. When the surface temperature of the pressing roller 53 becomes not less than 80 degC (10 degC or more above the set temperature), the pressing roller 53 is rotated idly to cool it down until the surface temperature of the pressing roller 53 becomes less than 80 degC (70 degC which is the setting temperature, for example).

Figure 16A:
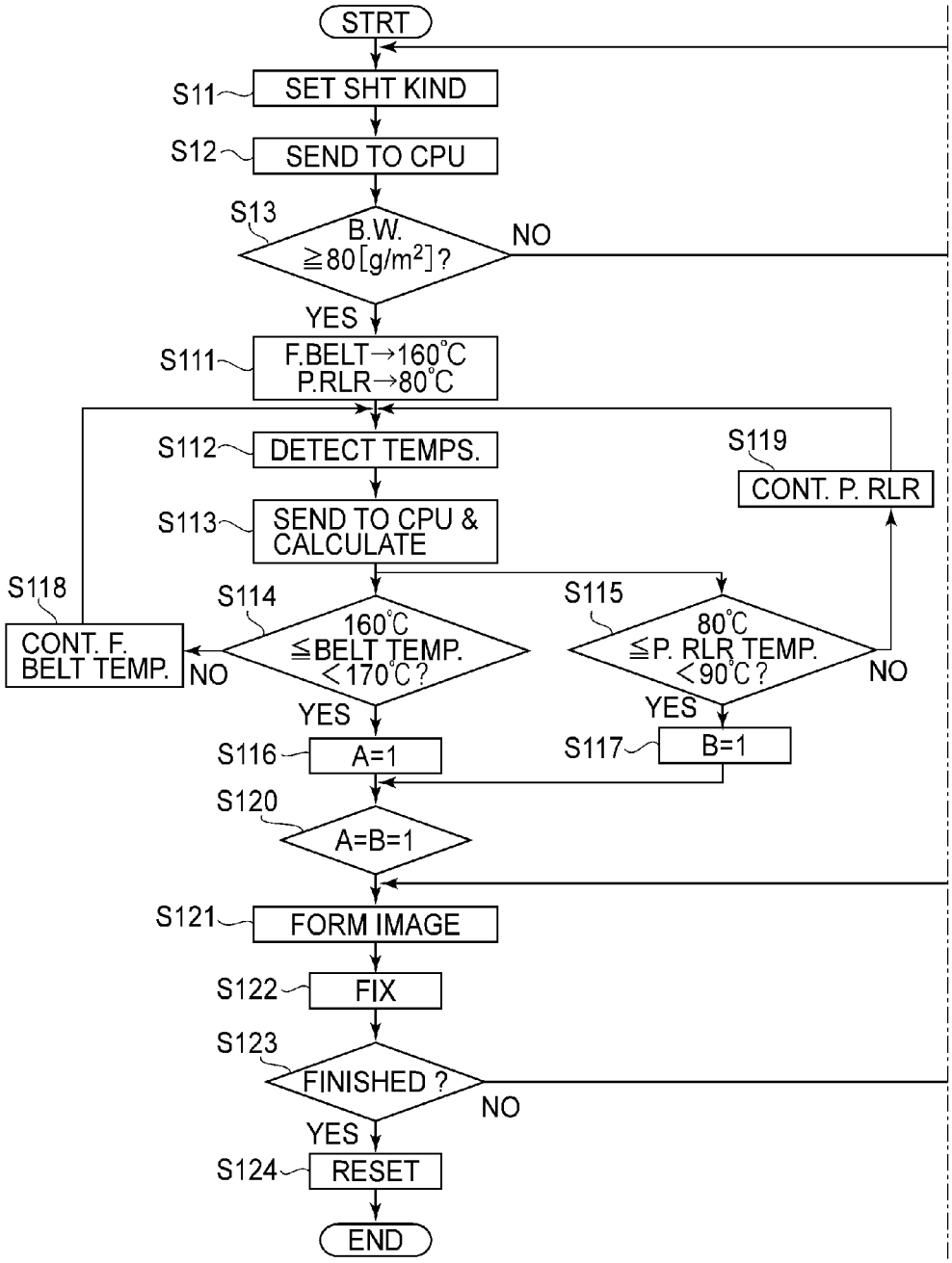
FIG. 16 is a flow chart showing an example of the control flow in the first embodiment.
Figures 16, 16B:
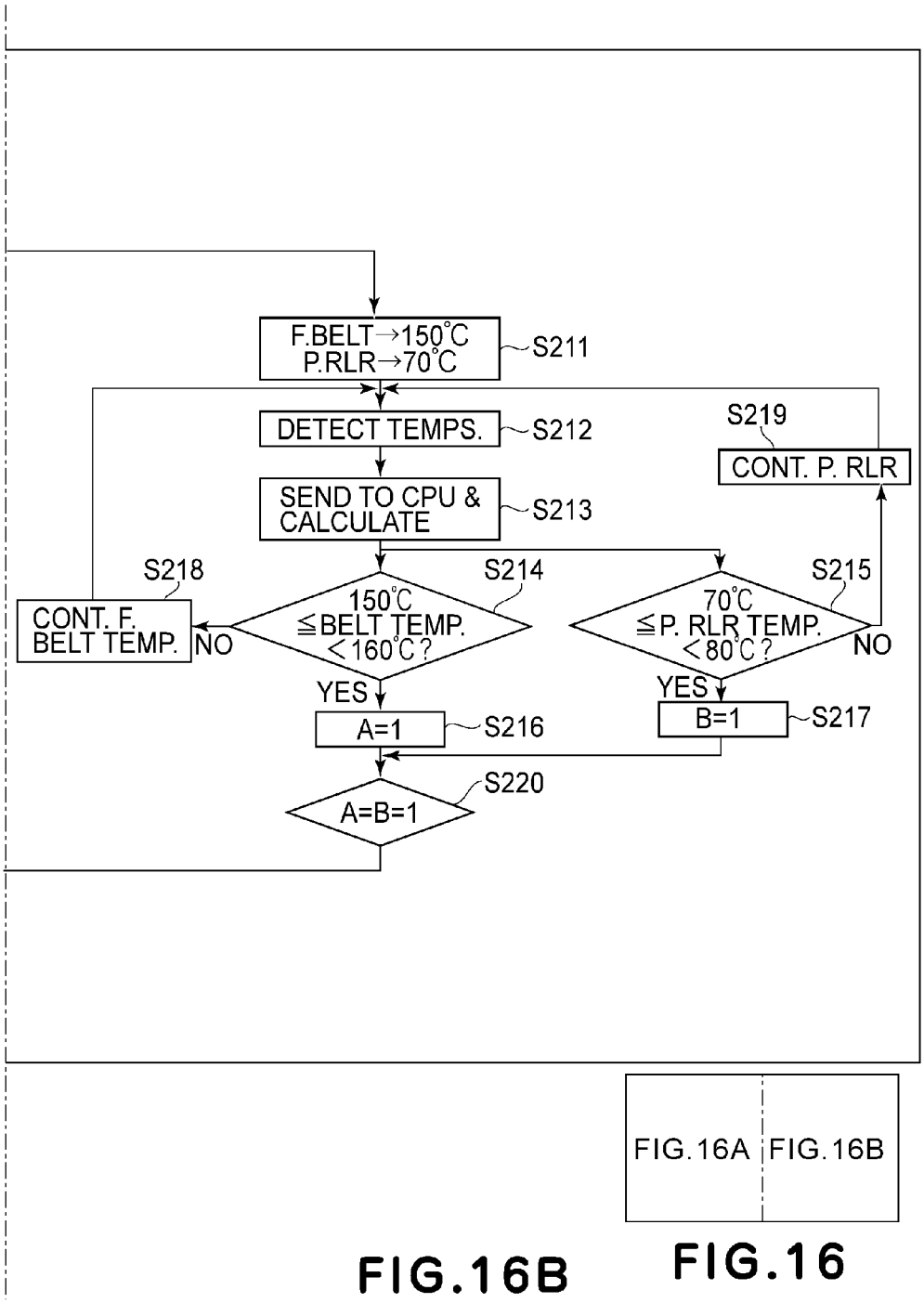

Referring to a flow chart of FIG. 16, FIG. 16A, and FIG. 16B, control of the apparatus will be described. When the user sets the kind of the recording material on the operating portion 101 of the image forming apparatus (S11), the information is sent to the CPU (controller) 102 (S12). On the basis of the information, the CPU102 refers to the memory 103 to discriminate whether the recording material is a thin paper sheet or a paper sheet having a thickness not less than normal plain paper sheet (S13). More specifically, in the S13, it is discriminated whether or not the basis weight of the recording material is equal to or larger than 80 g/m^2. If it is equal to or larger than 80 g/m^2 in the step S13, the surface temperature of the fixing belt 50 is controlled at 160 degC, and the surface temperature of the pressing roller 53 is controlled at 80 degC (S111). The surface temperatures of the fixing belt 50 and the pressing roller 53 are detected by the thermisters 58*a*, 58*b* (S112), and the detection results are transferred to the CPU102 (S113). The CPU102 discriminates whether or not the surface temperature of the fixing belt 50 is not less than 160 degC and less than 170 degC, and whether or not the surface temperature of the pressing roller 53 is not less than 80 degC and less than 90 degC (S114, S115).

If the surface temperature of the fixing belt 50 is not less than 160 degC and less than 170 degC in the step S114, the flag A is set to 1 (S116). If the surface temperature of the pressing roller 53 is not less than 80 degC and less than 90 degC in the step S115, the flag B is set to 1 (S117). If the surface temperature of the fixing belt 50 the less than 160 degC in the step S114, the electric current is applied to the IH coil 51 to generate heat in the fixing belt 50 (S118). If the surface temperature of the pressing roller 53 is less than 80 degC in the step S115, the halogen heater 57 is actuated to heat the pressing roller 53 (S119). If the surface temperature the fixing belt is not less than 170 degC in the step S114, the fixing belt 50 is idly rotated to cool it (S118). If the surface temperature of the pressing roller 53 is not less than 90 degC in the step S115, the pressing roller 53 is idly rotated to cool it (S119). Thus, the temperatures of the fixing belt 50 and the pressing roller 53 are controlled in the steps S118, S119.

If flag A=flag B=1 in the steps S116, S117 (S120), the image forming operation is carried out (S121), and then the fixing operation is carried out (S122). More particularly, a toner image is formed by the toner image forming means, and is transferred onto the recording material, and the recording material having the transferred toner image is fed into the fixing nip of the fixing device. If the image formation is not finished (S123), the operation returns to S11. If, on the other hand, the image formation is finished, the flag is reset (S124), and the image forming operation is completed.

If the discrimination in the step S13 is that the basis weight of the recording material is less than 80 g/m^2, the surface temperature of the fixing belt 50 is controlled at 150 degC, and the surface temperature of the pressing roller 53 is controlled at 70 degC (S211). The surface temperatures of the fixing belt 50 and the pressing roller 53 are detected by the thermisters 58*a*, 58*b* (S212), and the detection results are transferred to the CPU102 (S213). The CPU102 discriminates whether or not the surface temperature of the fixing belt 50 is not less than 150 degC and less than 160 degC, and whether or not the surface temperature of the pressing roller 53 is not less than 70 degC and less than 80 degC (S214, S215).

If the surface temperature of the fixing belt 50 is not less than 150 degC and less than 160 degC in the step S214, the flag A is set to 1 (S216). If the surface temperature of the pressing roller 53 is not less than 70 degC and less than 80 degC in the step S215, the flag B is set to 1 (S217). If the surface temperature of the fixing belt 50 is less than 150 degC in the step S214, the electric current is applied to the IH coil 51 to generate heat in the fixing belt 50 (S218). If the surface temperature of the pressing roller 53 is less than 70 degC in the step S215, the halogen heater 57 is actuated to heat the pressing roller 53 (S219). If the surface temperature the fixing belt is not less than 160 degC in the step S214, the fixing belt 50 is idly rotated to cool it (S218). If the surface temperature of the pressing roller 53 is not less than 80 degC in the step S215, the pressing roller 53 is idly rotated to cool it (S219). Thus, the temperatures of the fixing belt 50 and the pressing roller 53 are controlled in the steps S218, S219.

If flag A=flag B=1 in the steps S216, S217 (S220), the image forming operation is carried out (S121), and then the fixing operation is carried out (S122). If the image formation is not finished (S123), the operation returns to S11. If, on the other hand, the image formation is finished, the flag is reset (S124), and the image forming operation is completed.

As described above, in this embodiment, in the outlet of the fixing nip, the fixing condition of the fixing device 500 is set such that the viscosity of the upper layer toner is not higher than 1500 (Pa·s) and, the viscosity of the lower layer toner is not lower than 3000 (Pa·s). As the fixing condition, the surface temperatures of the fixing belt 50 as the heating member and the pressing roller 53 as the pressing member are taken and are controlled to meet the range of the toner viscosity.

In the case of the toner used in this embodiment, the surface temperature of the fixing belt 50 and the surface temperature of the pressing roller 53 are controlled in accordance with the kind of the recording material such that the toner surface temperature at the outlet of the fixing nip is higher than 105 degC, and the toner interface temperature there is lower than 100 degC. More specifically, if the basis weight of the recording material is not less than 80 g/m^2, the surface temperature of the fixing belt 50 is temperature controlled at 160 degC, and the surface temperature of the pressing roller 53 is controlled at 80 degC. It, on the other hand, the basis weight of the recording material is not more than 80 g/m^2, the surface temperature of the fixing belt 50 is controlled at 150 degC, and the surface temperature of the pressing roller 53 is temperature controlled at 70 degC. The set temperatures are different if the used image forming apparatus and/or the used toner is different.

The set temperatures are constant irrespective of the density of the image. In the case of the low toner deposition amount system, the decrease of the glossiness in a high density portion is remarkable, but is not remarkable in a half-tone portion. Therefore, when the toner image formed with the maximum toner deposition amount is fed to the fixing device 500 under the above-described fixing conditions, it will suffice if the viscosity of the portion of the toner image contacting the fixing belt 50 and the viscosity of the portion thereof contacting the recording material satisfy the range limitations. By doing so, in the low toner deposition amount system, the surface of the toner is melted properly, and the recording material side of the toner is not too much melted.

Second Embodiment

Referring to FIGS. 17, 18, 19 and 20, a second embodiment of the present invention will be described. In this embodiment, in a continuous sheet processing operation, the difference between the viscosities of the upper layer toner and the lower layer toner is made proper irrespective of the sheet processing number.

The fundamental structures of the image forming apparatus and fixing device 500 of this embodiment are similar and those of the first embodiment, and therefore, common descriptions are omitted for simplicity. The low toner deposition amount system is also employed also in this embodiment, and the toner deposition amount of the monochromatic solid image is 0.3 (mg/cm^2), and the maximum toner deposition amount is 0.6 (mg/cm^2). The maximum toner deposition amount on the recording material is set to be twice the toner deposition amount of the monochromatic solid image. Even when a three color or four color image is outputted, the maximum toner deposition amount is set to be 0.6 (mg/cm^2). In this embodiment, an initial surface temperature of the fixing belt 50 is 160 degC, and an initial surface temperature of the pressing roller 53 is 80 degC, and the process speed is 300 (mm/s).

Figure 18:
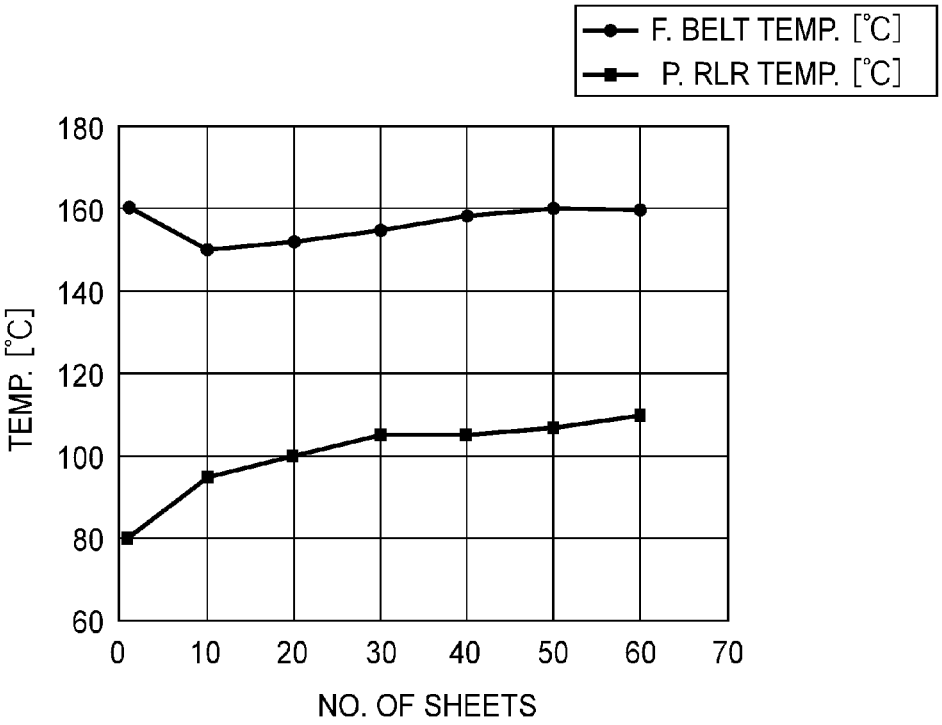
FIG. 18 shows changes of the surface temperatures of the fixing belt and the pressing roller.

FIG. 18 shows a change of the surface temperatures of the fixing belt 50 and the pressing roller 53 when recording materials CS-814 available from Canon-Kabushiki Kaisha having a basis weight of 81 (g/m^2) are continuously processed. The abscissa of FIG. 18 is a number of the processed sheets, and the ordinate is the surface temperature of the members.

As shown in FIG. 18, the surface temperature of the fixing belt 50 rises to 160 degC at 60 sheets processed, and the pressing roller 53 absorbs the heat from the fixing belt 50 so that the surface temperature of the pressing roller 53 rises to 110 degC. Therefore, the temperature difference between the upper side and the lower side of the toner becomes difficult to maintain, with the result that the foundation effect disappears, and the glossiness decreases (Table 1).

Figure 17:
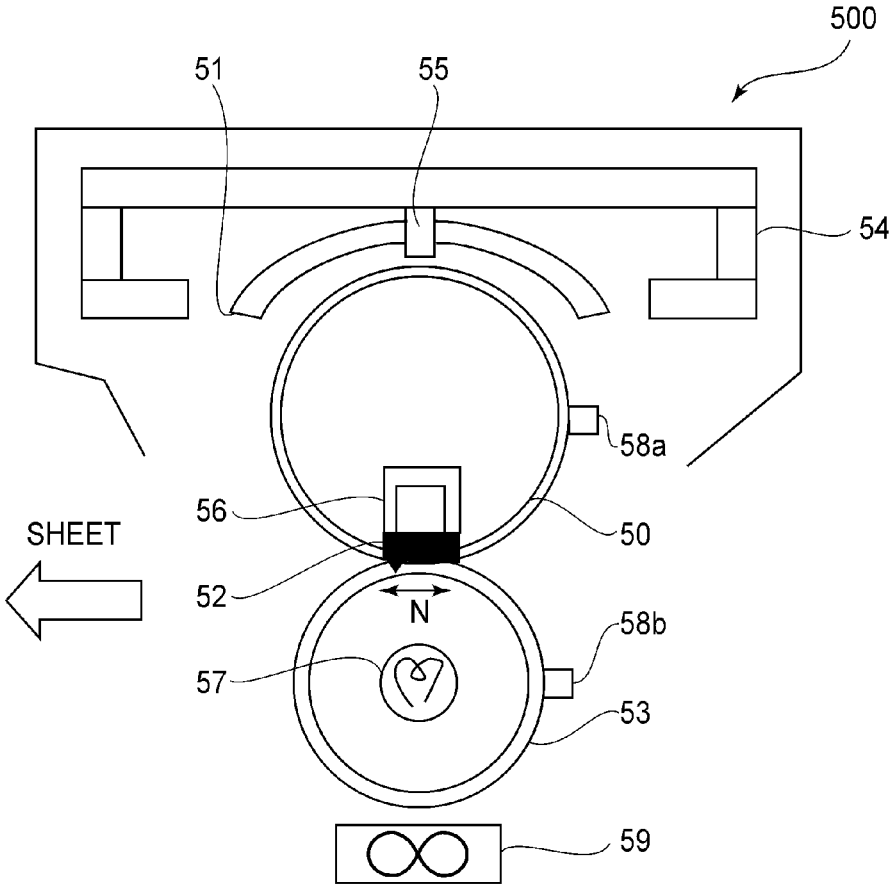
FIG. 17 is a substantial sectional view of a fixing device according to a second embodiment of the present invention.

Therefore, as shown in FIG. 17, a fan 59 as cooling means for pressing-roller cooling is provided at a side opposite from the fixing belt 50 with respect to the pressing roller 53. To the surfaces of the fixing belt 50 and the pressing roller 53, thermisters 58*a*, 58*b* as temperature detectors are provided. The thermisters 58*a*, 58*b* detect the surface temperature of the fixing belt 50 and the pressing roller 53, and the pressing roller cooling fan 59 is driven in accordance with the detection results. In this embodiment, when the surface temperature of the pressing roller 53 is not less than a predetermined temperature, the fan 59 is driven to cause the air to impinge upon the surface of the pressing roller 53 to cool the pressing roller 53.

A description of this arrangement will be provided in detail. Similarly to the first embodiment, also in this embodiment, the fixing condition of the fixing device 500 is set such that the viscosity of the upper layer toner is not higher than 1500 (Pa·s) and the viscosity of the lower layer toner is not lower than 3000 (Pa·s). More specifically, when the recording material has a basis weight of less than 80 (g/m^2), the surface temperature of the fixing belt 50 is controlled at 160 degC, and the surface temperature of the pressing roller 53 is controlled at 80 degC. When the recording material has a basis weight of not more than 80 (g/m^2), the surface temperature of the fixing belt 50 is controlled at 150 degC, and the surface temperature of the pressing roller 53 is controlled at 70 degC.

Figure 19:
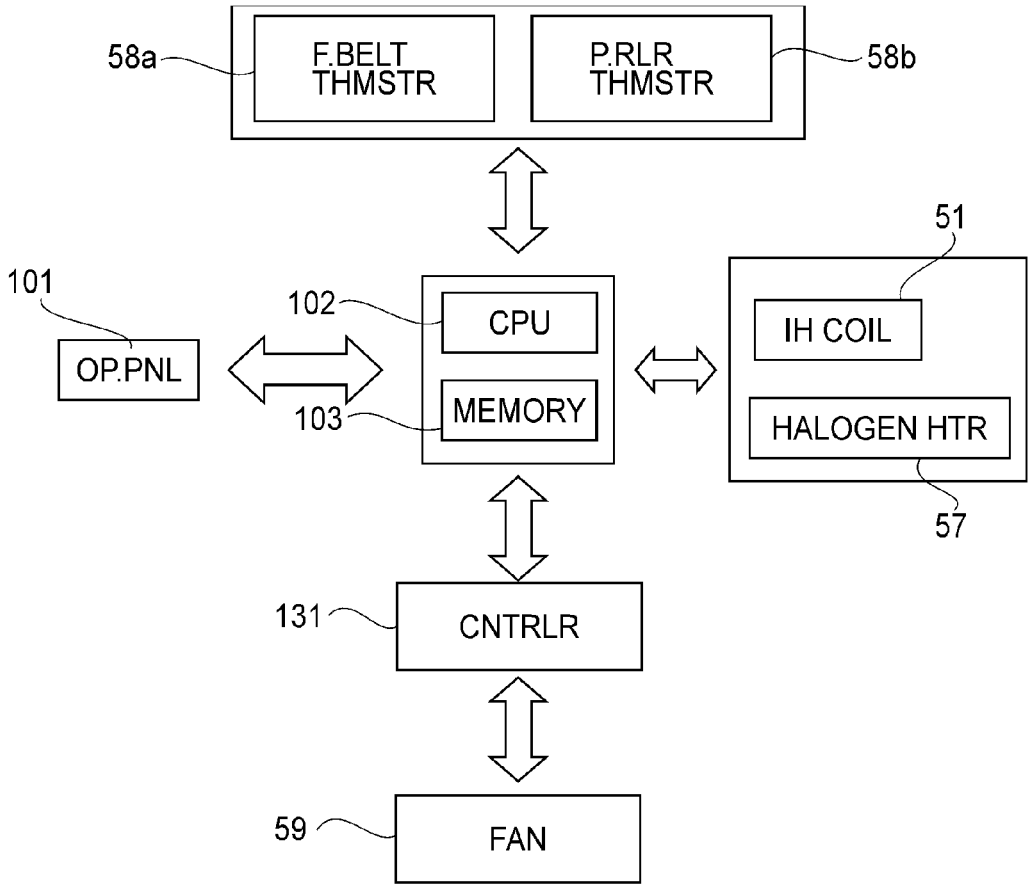
FIG. 19 is a control block diagram of the fixing device according to the second embodiment.

Referring to FIG. 19, a control of this embodiment will be described. First, the user designates a kind of the recording material in an operating portion 101. The information is transferred to the CPU102, and it is discriminated whether or not the basis weight of the kind of paper is equal to or larger than 80 (g/m^2), referring to the memory 103.

A thermister 58*a* for the fixing belt and a thermister 58*b* for the pressing roller detect the surface temperatures of the fixing belt 50 and the pressing roller 53, respectively. The detection results are transferred to the CPU102, which discriminates whether or not the surface temperature of the fixing belt 50 and the surface temperature of the pressing roller 53 are within the predetermined range.

When the basis weight of the recording material is not less than 80 (g/m^2), and the surface temperature of the fixing belt 50 is less than 160 degC, a current is applied to the IH coil 51 to heat the fixing belt 50 until the surface temperature of the fixing belt 50 becomes 160 degC. On the other hand, when the surface temperature of the fixing belt 50 is not less than 160 degC, the current is not applied to the IH coil 51. When the surface temperature of the fixing belt 50 becomes not less than 170 degC (10 degC or more higher than the set temperature), the fixing belt 50 is rotated idly until the surface temperature of the fixing belt 50 becomes less than 170 degC (160 degC which is the set temperature, for example) to cool it down.

If surface temperature of the pressing roller 53 is less than 80 degC, the halogen heater 57 is lighted on until the surface temperature of the pressing roller 53 becomes 80 degC to heat the pressing roller 53. If the surface temperature of the pressing roller 53 is not less than 80 degC, the halogen heater 57 is not lighted. When the surface temperature of the pressing roller 53 becomes not lower than 90 degC (predetermined temperature, higher than the set temperature by 10 degC or higher) due to the continuous sheet processing, the CPU102 sends a signal to a cooling fan controller 131 to drive the fan 59. The operation of the fan 59 is continued until the surface temperature of the pressing roller 53 becomes less than 90 degC (80 degC which is set temperature, for example) to cool the pressing roller 53.

On the other hand, when the basis weight of the recording material is less than 80 (g/m^2), and the surface temperature of the fixing belt 50 is less than 150 degC, the current is applied to the IH coil 51 to heat the fixing belt 50 until the surface temperature of the fixing belt 50 becomes 150 degC. On the other hand, when the surface temperature of the fixing belt 50 is not less than 150 degC, the current is not applied to the IH coil 51. When the surface temperature of the fixing belt 50 becomes not less than 160 degC (10 degC or more higher than the set temperature), the fixing belt 50 is rotated idly until the surface temperature of the fixing belt 50 becomes less than 160 degC (150 degC which is the set temperature, for example) to cool it down.

If surface temperature of the pressing roller 53 is less than 70 degC, the halogen heater 57 is lighted on until the surface temperature of the pressing roller 53 becomes 70 degC to heat the pressing roller 53. If the surface temperature of the pressing roller 53 is not less than 70 degC, the halogen heater 57 is not lighted. When the surface temperature of the pressing roller 53 becomes not lower than 80 degC (predetermined temperature, higher than the set temperature by 10 degC or higher) due to the continuous sheet processing, the CPU102 sends a signal to a cooling fan controller 131 to drive the fan 59. The operation of the fan 59 is continued until the surface temperature of the pressing roller 53 becomes less than 80 degC (70 degC which is set temperature, for example) to cool the pressing roller 53.

Figure 20A:
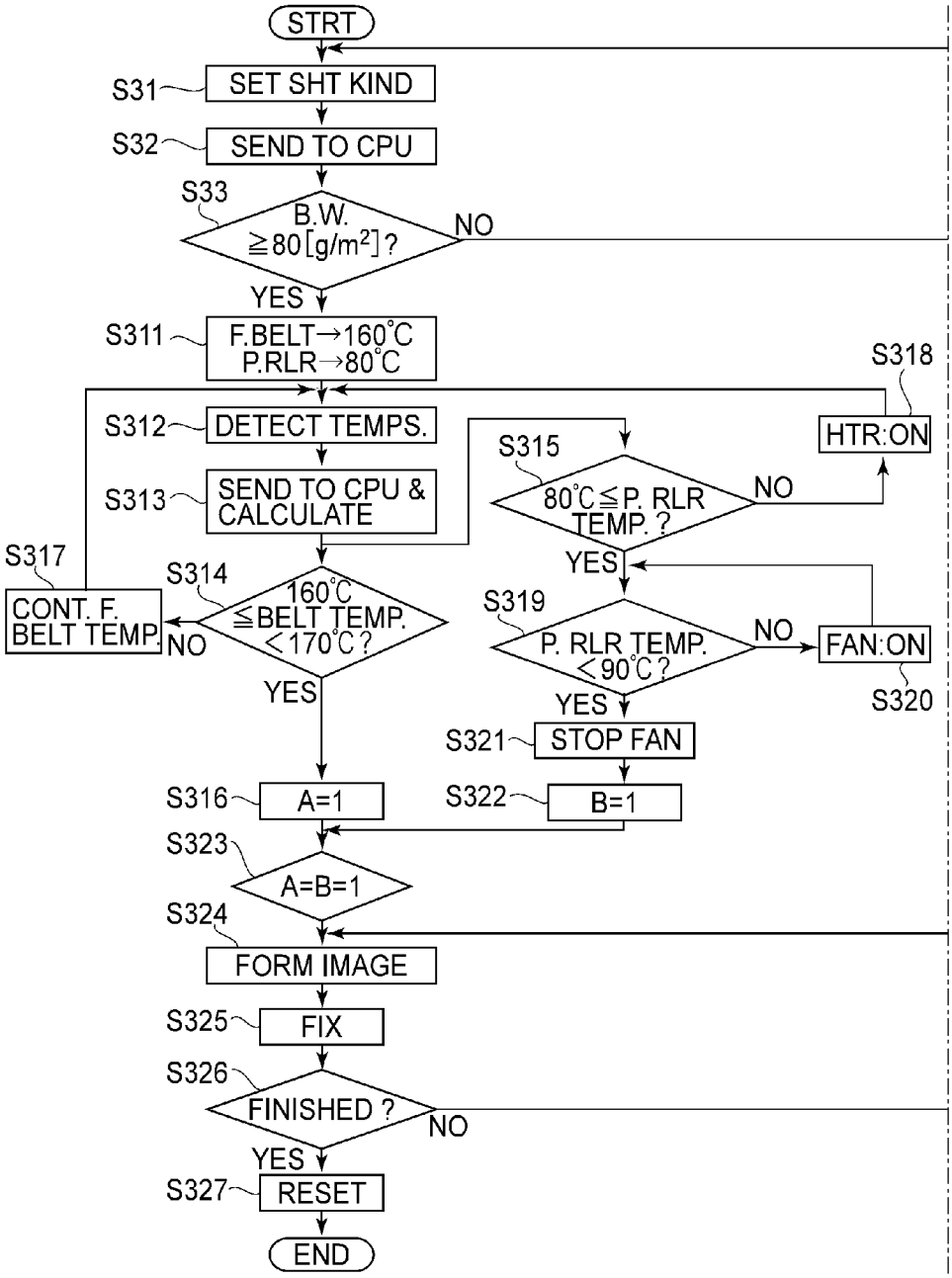
FIG. 20 is a flow chart showing an example of the control flow in the second embodiment.
Figures 20, 20B:
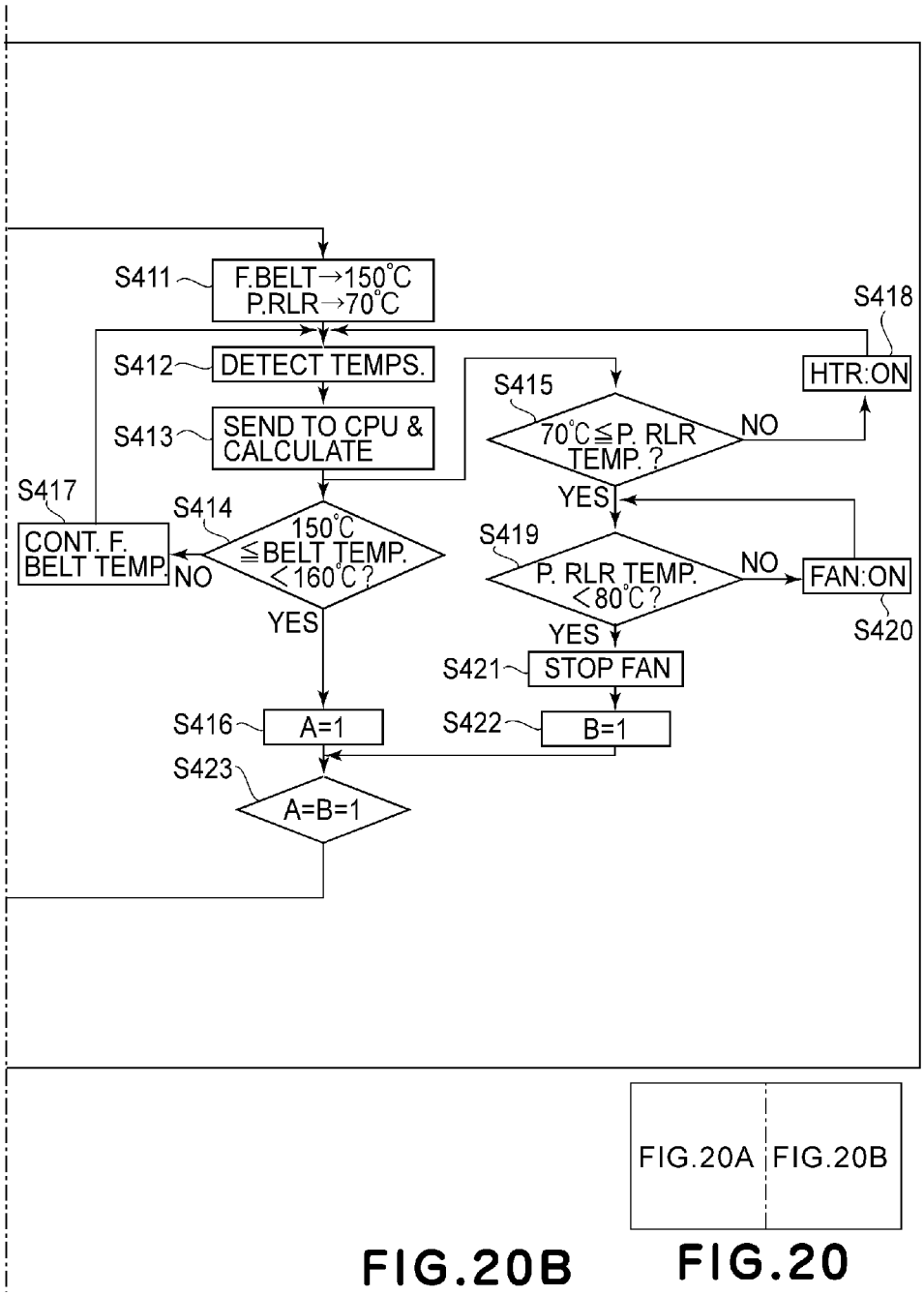

Referring to a flow chart of FIG. 20, FIG. 20A, and FIG. 20B, the control of the apparatus will be described. When the user sets the kind of the recording material on the operating portion 101 of the image forming apparatus (S31), the information is sent to the CPU (controller) 102 (S32). On the basis of the information, the CPU102 refers to the memory 103 to discriminate whether or not the recording material is thin paper or plain paper or thicker paper (S33). More specifically, in the S33, it is discriminated whether or not the basis weight of the recording material is equal to or larger than 80 g/m^2. If it is equal to or larger than 80 g/m^2, the surface temperature of the fixing belt 50 is controlled at 160 degC, and the surface temperature of the pressing roller 53 is controlled at 80 degC (S311). The surface temperatures of the fixing belt 50 and the pressing roller 53 are detected by the thermisters 58*a*, 58*b* (S312), and the detection results are transferred to the CPU102 (S313). The CPU102 discriminates whether or not the surface temperature of the fixing belt 50 is not less than 160 degC and less than 170 degC, and whether or not the surface temperature of the pressing roller 53 is not less than 80 degC and less than 90 degC (S314, S315).

If the surface temperature of the fixing belt 50 is not less than 160 degC and less than 170 degC in the step S314, the flag A is set to 1 (S316). If the surface temperature of the fixing belt 50 is less than 160 degC in the step S314, the electric current is applied to the IH coil 51 to generate heat in the fixing belt 50 (S317). If the surface temperature the fixing belt is not less than 170 degC in the step S314, the fixing belt 50 is idly rotated to cool it (S317).

If the surface temperature of the pressing roller 53 is less than 80 degC in the step S315, the halogen heater 57 is actuated to heat the pressing roller 53 (S318). And then, the operation returns to S312. If the surface temperature of the pressing roller 53 is not lower than 80 degC in the step S315, it is discriminated whether or not the surface temperature of the pressing roller 53 is lower than 90 degC (S319). If the surface temperature of the pressing roller 53 is not lower than 90 degC in the step S319, the fan 59 is driven to cool the pressing roller 53 (S320). If, on the other hand, the surface temperature of the pressing roller 53 is lower than 90 degC in the step S319, the fan 59, if it is operated, is stopped (S321), and the flag B is set to 1 (S322).

If flag A=flag B=1 in the steps S316, S322 (S323), the image forming operation is carried out (S324), and then the fixing operation is carried out (S325). More particularly, a toner image is formed by the toner image forming means, and is transferred onto the recording material, and the recording material having the transferred toner image is fed into the fixing nip of the fixing device. If the image formation is not finished (S326), the operation returns to S31. If, on the other hand, the image formation is finished, the flag is reset (S327), and the image forming operation is completed.

If the discrimination in the step S33 is that the basis weight of the recording material is less than 80 g/m^2, the surface temperature of the fixing belt 50 is controlled at 150 degC, and the surface temperature of the pressing roller 53 is controlled at 70 degC (S411). The surface temperatures of the fixing belt 50 and the pressing roller 53 are detected by the thermisters 58*a*, 58*b* (S412), and the detection results are transferred to the CPU102 (S413). The CPU102 discriminates whether or not the surface temperature of the fixing belt 50 is not less than 150 degC and less than 160 degC, and whether or not the surface temperature of the pressing roller 53 is not lower than 70 degC (S414, S415).

If the surface temperature of the fixing belt 50 is not less than 150 degC and less than 160 degC in the step S414, the flag A is set to 1 (S416). If the surface temperature of the fixing belt 50 is less than 150 degC in the step S414, the electric current is applied to the IH coil 51 to generate heat in the fixing belt 50 (S417). If the surface temperature the fixing belt is not less than 160 degC in the step S414, the fixing belt 50 is idly rotated to cool it (S417).

If the surface temperature of the pressing roller 53 is less than 70 degC in the step S415, the halogen heater 57 is actuated to heat the pressing roller 53 (S418). The operation returns to S412. If the surface temperature of the pressing roller 53 is not lower than 70 degC in the step S415, it is discriminated whether or not the surface temperature of the pressing roller 53 is lower than 80 degC (S419). If the surface temperature of the pressing roller 53 is not lower than 80 degC in the step S419, the fan 59 is driven to cool the pressing roller 53 (S420). If, on the other hand, the surface temperature of the pressing roller 53 is lower than 80 degC in the step S319, the fan 59, if it is operated, is stopped (S421), and the flag B is set to 1 (S422).

If flag A=flag B=1 in the steps S416, S417 (S423), the image forming operation is carried out (S324), and then the fixing operation is carried out (S325). If the image formation is not finished (S326), the operation returns to S31. If, on the other hand, the image formation is finished, the flag is reset (S327), and the image forming operation is completed.

In the case of this embodiment, a fan 59 for cooling the pressing roller 53 as the pressing member is provided, and therefore, even if the surface temperature of the pressing roller 53 becomes high due to the continuous sheet processing, it can be quickly cooled down by the fan 59. For this reason, the difference between the viscosities of upper layer toner and the lower layer toner can be kept proper irrespective of the sheet processing number in the continuous sheet processing, and the down time can be shortened.

In this embodiment, an air cooling system is used to cool the pressing roller, but the present invention is not limited to such a system. For example, a cooling element such as a Peltier element is usable. In the other respects, the structure and the functions are similar to those of the first embodiment.

Third Embodiment

Figure 21:
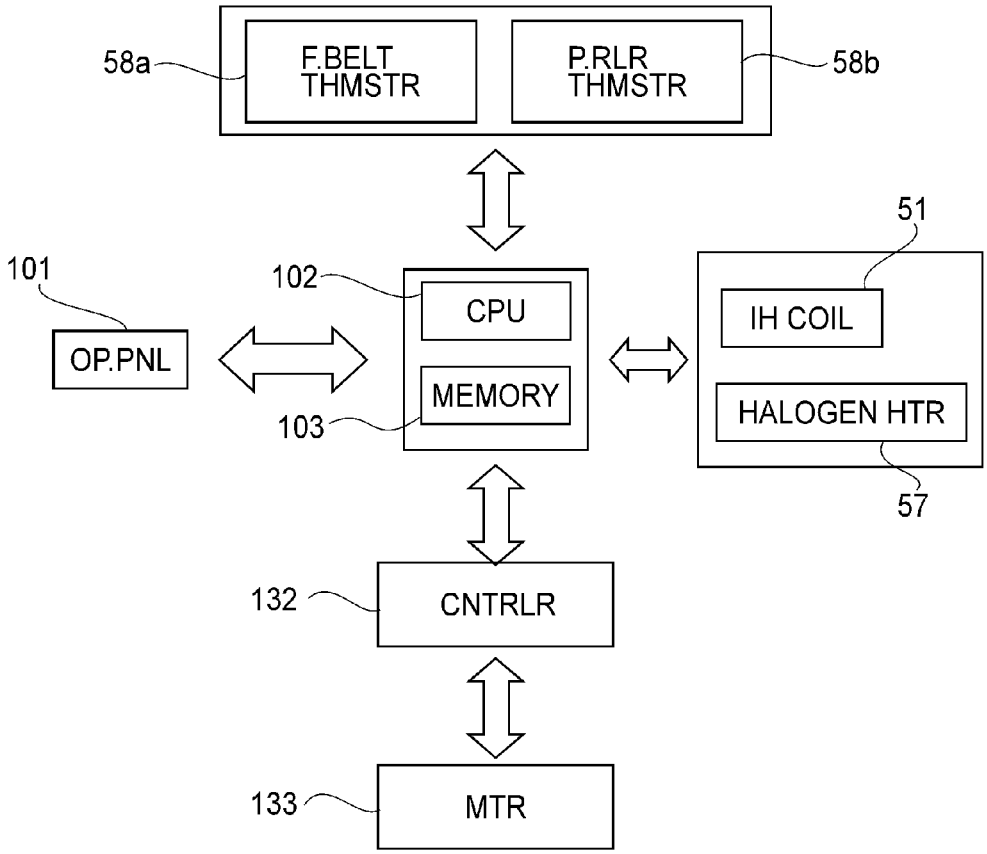
FIG. 21 is a control block diagram of a fixing device according to a third embodiment of the present invention.
Figure 22:
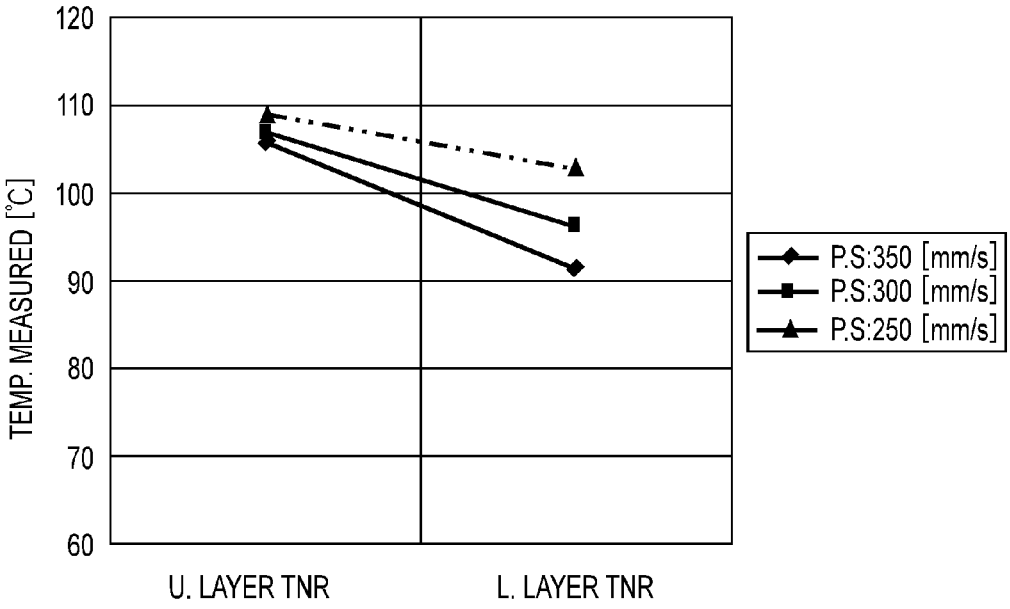
FIG. 22 shows a result of the measurements of the temperatures of the upper layer toner and the lower layer toner when a process speed (P.S) is changed.
Figure 23A:
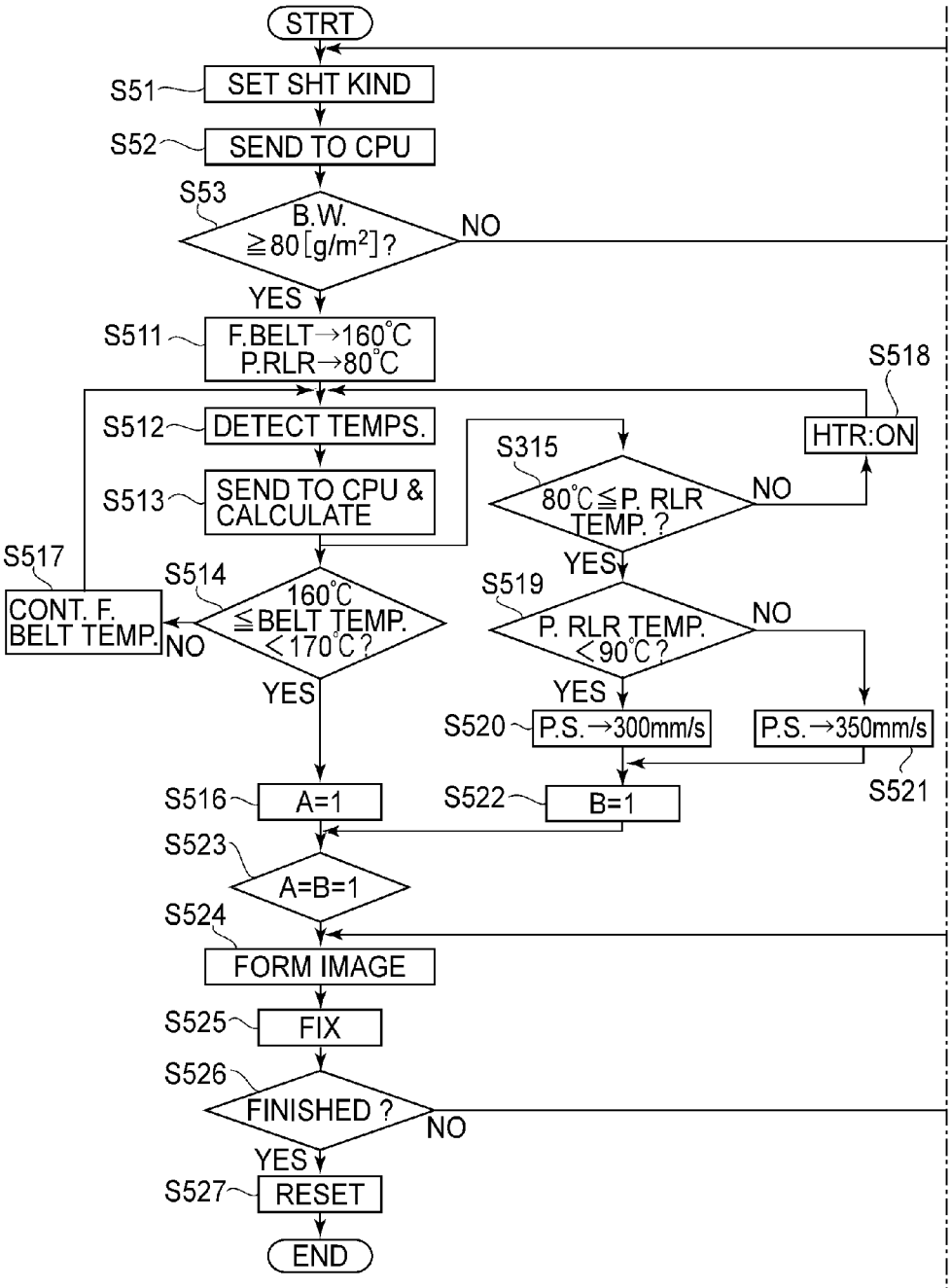
FIG. 23 is a flow chart showing an example of the control flow of the third embodiment.
Figures 23, 23B:
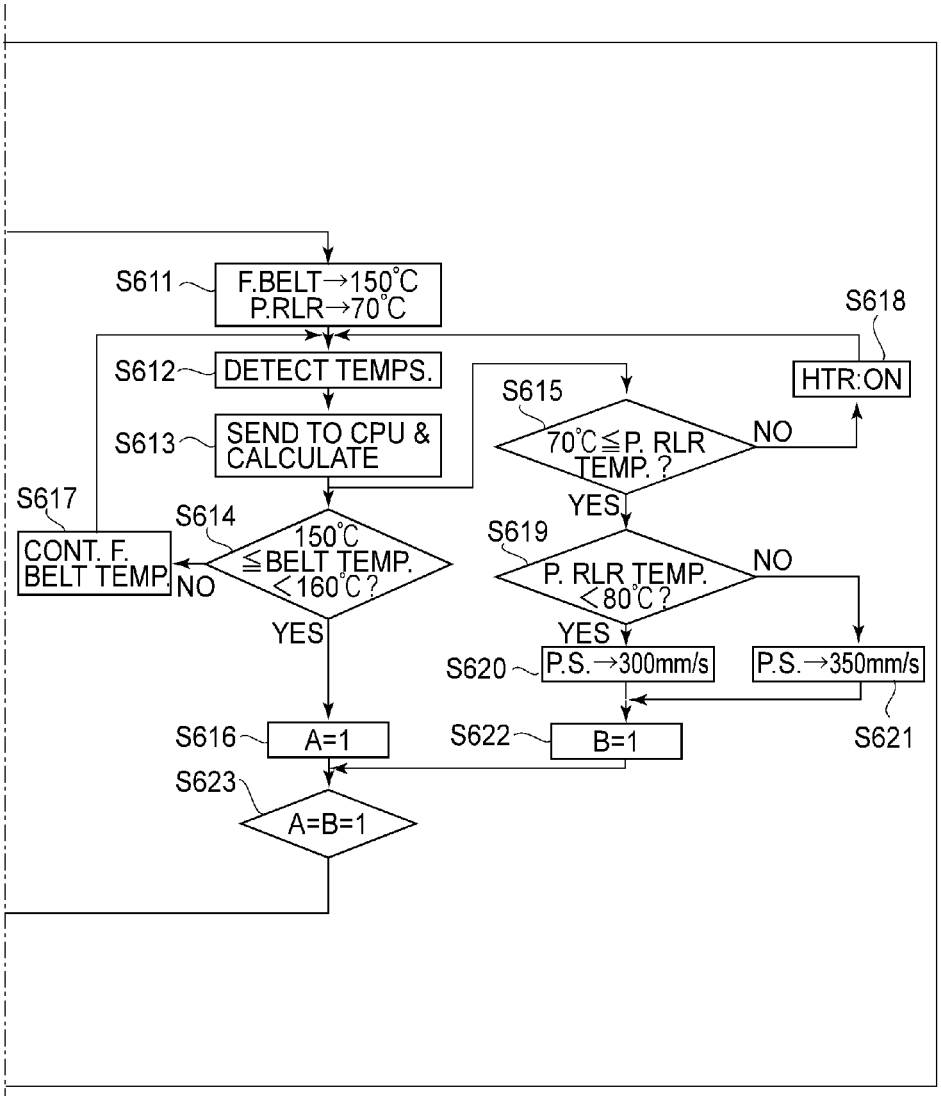

Referring to FIGS. 21, 22 and 23, a third embodiment of the present invention will be described. In the above-described first embodiment, in order to provide a viscosity difference between the upper layer toner and the lower layer toner, the surface temperatures of the fixing belt and the pressing roller are controlled. The controlled fixing conditions are the surface temperature of the fixing belt and the surface temperature of the pressing roller. In this embodiment, the fixing condition for providing the viscosity difference between the upper layer toner and the lower layer toner is fixing time for which the recording material is in the fixing nip. That is, in this embodiment, the fixing time is set so that the viscosity of the upper layer toner is not higher than 1500 (Pa·s the, and the viscosity of the lower layer toner is not lower than 3000 (Pa·s).

The fundamental structures of the image forming apparatus and fixing device 500 of this embodiment are similar and those of the first embodiment, and therefore, common descriptions are omitted for simplicity. The low toner deposition amount system is also employed also in this embodiment, and the toner deposition amount of the monochromatic solid image is 0.3 (mg/cm^2), and the maximum toner deposition amount is 0.6 (mg/cm^2). The maximum toner deposition amount on the recording material is set to be twice the toner deposition amount of the monochromatic solid image. Even when a three color or four color image is outputted, the maximum toner deposition amount is set to be 0.6 (mg/cm^2).

In this embodiment, the process speed of the image forming apparatus is variable in order to set the fixing time. More specifically, as shown in FIG. 22, a rotational speed of a motor 133 for rotating the pressing roller is controlled. In this embodiment, the fixing belt is driven by the pressing roller, and the pressing roller is rotated, but when the fixing roller is rotated and drives the pressing roller, the rotational speed of the fixing roller is controlled.

The rotational speed of the motor 133 is in interrelated with a rotational speed of a motor for driving a photosensitive drum and an intermediary transfer belt and/or for driving a feeding member or the like roller for feeding the recording material. Therefore, the motor controller 132 controls the rotational speed for the motor for driving various members as well as the motor 133, thus controlling the process speed of the image formation.

FIG. 22 is results of temperature measurements of the upper layer toner and the lower layer toner when the surface temperature of the fixing belt is 160 degC, and the surface temperature of the pressing roller is 100 degC, and the process speed (P.S) is changed. FIG. 22 is temperatures at the outlet of the fixing nip. The process speed is the same as the rotational speed of the pressing roller and the fixing belt.

The method of the temperature measurement is similar to the in first embodiment. As shown in FIG. 4, PES tape having a thickness of 10 (μm) likened to the toner is on the CS-814 recording material, and the thermocouples (thin extrafine thermocouple KFST-10-100-200 available from Kabushiki Kaisha ANBESMT, Japan) are stuck.

From the temperature measurement results of FIG. 22, the upper layer toner temperature is higher than 98 degC at any process speed, and therefore, the toner melts to fill the gaps between and among the lower layer toner particles. On the other hand, the lower layer toner temperature is lower than 102 degC if the process speed is not lower than 300 (mm/s), and therefore, the lower layer toner does not melt too much, thus providing the foundation effect to enhance the glossiness. However, when is process speed is lower than 300 (mm/s), the temperature of the lower layer toner exceeds 100 degC, and therefore, the lower layer toner is melted too much, and the foundation effect does not work with the result of low glossiness.

In this embodiment, too, in order to keep the viscosities of the upper layer toner and the lower layer toner in the range, the surface temperature of the fixing belt is controlled at 160 degC, and the surface temperature of the pressing roller is controlled at 80 degC, when the basis weight of the recording material is not less than 80 (g/m^2). When the recording material has a basis weight of less than 80 (g/m^2), the surface temperature of the fixing belt 50 is controlled at 150 degC, and the surface temperature of the pressing roller 53 is controlled at 70 degC.

Referring to FIG. 21, the control in this embodiment will be described. First, the user designates a kind of the recording material in an operating portion 101. The information is transferred to the CPU102, which discriminates whether or not the basis weight of the recording material is not less than 80 (g/m^2), referring to memory 103.

A thermister 58*a* for the fixing belt and a thermister 58*b* for the pressing roller detect the surface temperatures of the fixing belt and the pressing roller, respectively. The detection results are transferred to the CPU102, which discriminates whether or not the surface temperature fixing belt and the surface temperature pressing roller are within the respective ranges. The process speed of the initial setting is 300 (mm/s).

When the basis weight of the recording material is not less than 80 (g/m^2), and the surface temperature of the fixing belt 50 is less than 160 degC, a current is applied to the IH coil 51 to heat the fixing belt 50 until the surface temperature of the fixing belt 50 becomes 160 degC. On the other hand, when the surface temperature of the fixing belt 50 is not less than 160 degC, the current is not applied to the IH coil 51. If the surface temperature of the fixing belt is not lower than 170 degC, it is idly rotated until the surface temperature of the fixing belt becomes lower than 170 degC.

If surface temperature of the pressing roller 53 is less than 80 degC, the halogen heater 57 is lighted on until the surface temperature of the pressing roller 53 becomes 80 degC to heat the pressing roller 53. If the surface temperature of the pressing roller 53 is not lower than 80 degC, the halogen heater 57 is not lighted. When the surface temperature of the pressing roller becomes not lower than 90 degC due to the continuous sheet processing, the CPU102 sends a signal to the motor controller 132 to change the process speed to 350 (mm/s).

On the other hand, when the basis weight of the recording material is less than 80 (g/m^2), and the surface temperature of the fixing belt 50 is less than 150 degC, the current is applied to the IH coil 51 to heat the fixing belt 50 until the surface temperature of the fixing belt 50 becomes 150 degC. On the other hand, when the surface temperature of the fixing belt 50 is not less than 150 degC, the current is not applied to the IH coil 51. If the surface temperature of the fixing belt is not lower than 160 degC, it is idly rotated until the surface temperature of the fixing belt becomes lower than 160 degC.

If surface temperature of the pressing roller 53 is lower than 70 degC, the halogen heater 57 is lighted on until the surface temperature of the pressing roller 53 becomes 70 degC to heat the pressing roller 53. If the surface temperature of the pressing roller 53 is not less than 70 degC, the halogen heater 57 is not lighted. When the surface temperature of the pressing roller becomes not lower than 80 degC due to the continuous sheet processing, the CPU102 sends a signal to the motor controller 132 to change the process speed to 350 (mm/s).

Referring to FIG. 23, FIG. 23A, and FIG. 23B, the control in this embodiment will be described. When the user sets the kind of the recording material on the operating portion 101 of the image forming apparatus (S51), the information is sent to the CPU (controller) 102 (S52). On the basis of the information, the CPU102 refers to the memory 103 to discriminate whether or not the recording material is thin paper or plain paper or thicker paper (S53). More specifically, in the step S53, it is discriminated whether or not the basis weight of the recording material is equal to or larger than 80 g/m^2. If it is equal to or larger than 80 g/m^2 in the step S53, the surface temperature of the fixing belt 50 is controlled at 160 degC, and the surface temperature of the pressing roller 53 is controlled at 80 degC (S511). The surface temperatures of the fixing belt 50 and the pressing roller 53 are detected by the thermisters 58*a*, 58*b* (S512), and the detection results are transferred to the CPU102 (S513). The CPU102 discriminates whether or not the surface temperature of the fixing belt 50 is not less than 160 degC and less than 170 degC, and whether or not the surface temperature of the pressing roller 53 is not less than 80 degC and less than 90 degC (S514, S315, and S519).

If the surface temperature of the fixing belt 50 is not less than 160 degC and less than 170 degC in the step S514, the flag A is set to 1 (S516). If the surface temperature of the fixing belt 50 is less than 160 degC in the step S514, the electric current is applied to the IH coil 51 to generate heat in the fixing belt 50 (S517). If the surface temperature the fixing belt is not less than 170 degC in the step S514, the fixing belt 50 is idly rotated to cool it (S517).

If the surface temperature of the pressing roller 53 is less than 80 degC in the step S315, the halogen heater 57 is actuated to heat the pressing roller 53 (S518). Then, the operation returns to the step S512. If the surface temperature of the pressing roller 53 is not lower than 80 degC in the step S515, it is discriminated whether or not the surface temperature of the pressing roller 53 is lower than 90 degC (S519). If the surface temperature of the pressing roller is lower than 90 degC in the step S519, the process speed is set to 300 (mm/s) (S520). If, on the other hand, the surface temperature of the pressing roller is not lower than 90 degC in the step S519, the process speed is set to 350 (mm/s) (S521). Then, the flag B is set to 1 (S522).

If flag A=flag B=1 in the steps S516, S522 (S523), the image forming operation is carried out (S524), and then the fixing operation is carried out (S525). More particularly, a toner image is formed by the toner image forming means, and is transferred onto the recording material, and the recording material having the transferred toner image is fed into the fixing nip of the fixing device. If the image formation is not finished (S526), the operation returns to S51. If, on the other hand, the image formation is finished, the flag is reset (S527), and the image forming operation is completed.

If the discrimination in the step S53 is that the basis weight of the recording material is less than 80 g/m^2, the surface temperature of the fixing belt 50 is controlled at 150 degC, and the surface temperature of the pressing roller 53 is controlled at 70 degC (S611). The surface temperatures of the fixing belt 50 and the pressing roller 53 are detected by the thermisters 58*a*, 58*b* (S612), and the detection results are transferred to the CPU102 (S613). The CPU102 discriminates whether or not the surface temperature of the fixing belt 50 is not less than 150 degC and less than 160 degC, and whether or not the surface temperature of the pressing roller 53 is not lower than 70 degC (S614, S615).

If the surface temperature of the fixing belt 50 is not lower than 150 degC and less than 160 degC in the step S114, the flag A is set to 1 (S616). If the surface temperature of the fixing belt 50 is less than 150 degC in the step S614, the electric current is applied to the IH coil 51 to generate heat in the fixing belt 50 (S617). If the surface temperature the fixing belt is not less than 160 degC in the step S614, the fixing belt 50 is idly rotated to cool it (S617).

If the surface temperature of the pressing roller 53 is less than 70 degC in the step S615, the halogen heater 57 is actuated to heat the pressing roller 53 (S618). And then, the operation returns to S612. If the surface temperature of the pressing roller 53 is not lower than 70 degC in the step S615, it is discriminated whether or not the surface temperature of the pressing roller 53 is lower than 80 degC (S619). If the surface temperature of the pressing roller is lower than 80 degC in the step S619, the process speed is set to 300 (mm/s) (S620). If, on the other hand, the surface temperature of the pressing roller is not lower than 80 degC in the step S619, the process speed is set to 350 (mm/s) (S621). Then, the flag B is set to 1 (S622).

If flag A=flag B=1 in the steps S616, S622 (S623), the image forming operation is carried out (S524), and then the fixing operation is carried out (S525). If the image formation is not finished (S526), the operation returns to S51. If, on the other hand, the image formation is finished, the flag is reset (S527), and the image forming operation is completed.

In this embodiment, the fixing time is controlled properly, by which the viscosity difference between the upper layer toner and the lower layer toner is controlled properly so that the glossiness of the high density portion can be improved. In addition, by controlling the fixing time in accordance with the surface temperature of the pressing roller, the difference of the viscosities of the upper layer toner and the lower layer toner can be kept properly irrespective of the sheet processing number.

The fixing time is the width of the fixing nip, measured in the feeding direction of the recording material, divided by the process speed, and in this embodiment, the process speed is changed to change the fixing time, as described above. In order to change the fixing time, the width of the fixing nip may be changed. For example, by changing the pressure of pressing the pressing roller to the fixing belt, the width of the fixing nip may be changed. As for the structure of changing the pressure of the pressing roller, the pressing roller is moved toward and away from the fixing belt by a cam mechanism. The other structures and functions are similar to those of the above-described second embodiment.

Other Embodiments

The above-described embodiments may be combined properly. For example, the temperature control of the fixing belt and the pressing roller are carried out according to the first embodiment, and the process speed and/or the pressure of the pressing roller are changed. By combining the second embodiment and the third embodiment, the temperature rise of the pressing roller by the continuous sheet processing can be avoided better.

In the embodiments, one of the heating member and the pressing member is a film (belt) and the other is a roller, but this is not inevitable. In such a case, the heating member and the pressing member may preferably be rotatable members press-contacted to each other, and for example, belts stretched around rollers are used as the rotatable members wherein the belts are press-contacted to each other, or a belt stretched around rollers is used wherein a roller is press-contacted to the belt.

In the foregoing embodiments, the image forming apparatus includes one fixing device (image heat pressing device). The image forming apparatus may include a plurality of fixing devices wherein the present invention is used each of the fixing devices.

In the embodiments described in the foregoing, the image forming apparatus include four image forming stations, but this is not inevitable and more or less image forming stations may be used. The image forming apparatus may be a printer, a copying machine, a facsimile machine or a complex machine including the functions of them. The present invention is applicable to the fixing devices of such image forming apparatuses with the same advantageous effects.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 181176/2011 filed Aug. 23, 2011 which is hereby incorporated by reference.

What is claimed is:

1. An image forming apparatus comprising:

an image forming device configured to form an unfixed toner image on a recording paper; and a fixing device configured to fix the unfixed toner image onto the recording material in a fixing nip by heat and pressure;

wherein in an image forming process of said image forming device, $0<B<\rho\pi L/(30\times3^{1/2})$ is satisfied, where L (μm) is a volume average particle size of toner of the unfixed toner image, ρ (g/cm^3) is a density of the toner, and B (mg/cm^2) is a maximum toner deposition amount, per unit area, on a predetermined recording paper, wherein said fixing device fixes the toner image while satisfying the conditions that, at an outlet of said fixing nip, the viscosity of a toner layer contacting said fixing device is not higher than 1500 (Pa·s), and the viscosity of a toner layer contacting the recording paper is not lower than 3000 (Pa·s).

2. An apparatus according to claim 1, wherein said fixing device includes a fixing member and a pressing member which form the fixing nip therebetween, a first detector configured to detect the temperature of said fixing member and a second detector configured to detect the temperature of said pressing member; and a controller configured to control the difference between the temperature detected by said first detector and the temperature detected by said second detector so that at the outlet of said fixing nip, the viscosity of the toner layer contacting said fixing device is not higher than 1500 (Pa·s), and the viscosity of the toner layer contacting the recording paper is not lower than 3000 (Pa·s).

3. An apparatus according to claim 1, wherein the time during which the toner image is in said fixing nip is set so that at the outlet of said fixing nip, the viscosity of the toner layer contacting said fixing device is not higher than 1500 (Pa·s), and the viscosity of the toner layer contacting the recording paper is not lower than 3000 (Pa·s).

4. An apparatus according to claim 1, wherein said fixing device fixes the toner image while satisfying the conditions that, at the outlet of said fixing nip, the viscosity of the toner layer contacting said fixing device is not lower than 100 (Pa·s), and the viscosity of the toner layer contacting the recording paper is not higher than 100000 (Pa·s).

5. An apparatus according to claim 1, wherein said image forming device is configured to form a multi-color superimposed toner image on the recording paper, and the maximum toner deposition amount per unit area is twice the maximum toner deposition amount of a monochromatic toner image per unit area.

6. An image forming apparatus comprising:

an image forming device configured to form an unfixed toner image on a recording paper; and a fixing device configured to fix the unfixed toner image onto the recording paper in a fixing nip by heat and pressure, wherein in an image forming process of said image forming device, $0<B<\rho\pi L/(30\times3^{1/2})$ is satisfied where L (μm) is a volume average particle size of toner of the unfixed toner image, ρ (g/cm^3) is a density of the toner, and B (mg/cm^2) is the maximum toner deposition amount, per unit area, on a predetermined recording paper, wherein said fixing device fixes the toner image while satisfying the conditions that, at an outlet of said fixing nip, the viscosity of a toner layer contacting said fixing device is not lower than 100 (Pa·s) and not higher than 1500 (Pa·s), and the viscosity of a toner layer contacting the recording paper is not lower than 3000 (Pa·s) and not higher than 100000 (Pa·s).

7. An apparatus according to claim 6, wherein said fixing device includes:

a fixing member and a pressing member which form the fixing nip therebetween;

a first detector configured to detect the temperature of said fixing member and a second detector configured to detect the temperature of said pressing member; and a controller configured to control the difference between the temperature detected by said first detector and the temperature detected by said second detector so that at the outlet of said fixing nip, the viscosity of the toner layer contacting said fixing device is not lower than 100 (Pa·s) and not higher than 1500 (Pa·s), and the viscosity of the toner layer contacting the recording paper is not lower than 3000 (Pa·s) and not higher than 100000 (Pa·s).

8. An apparatus according to claim 6, wherein the time during which the toner image is in said fixing nip is set so that at the outlet of said fixing nip, the viscosity of the toner layer contacting said fixing device is not lower than 100 (Pa·s) and not higher than 1500 (Pa·s), and the viscosity of the toner layer contacting the recording paper is not lower than 3000 (Pa·s) and not higher than 100000 (Pa·s).

9. An apparatus according to claim 6, wherein said image forming device is configured to form a multi-color superimposed toner image on the recording paper, and the maximum toner deposition amount per unit area is twice the maximum toner deposition amount of a monochromatic toner image per unit area.

* * * * *